US009273625B2

(12) United States Patent
Borg et al.

(10) Patent No.: US 9,273,625 B2
(45) Date of Patent: Mar. 1, 2016

(54) METHOD AND CONTROL APPARATUS FOR CONTROLLING A HIGH-PRESSURE FUEL SUPPLY PUMP CONFIGURED TO SUPPLY PRESSURIZED FUEL TO AN INTERNAL COMBUSTION ENGINE

(75) Inventors: Jonathan Borg, Erding (DE); Masanori Watanabe, Munich (DE); Ulf Dettmering, Munich (DE); Kenichiro Tokuo, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 766 days.

(21) Appl. No.: 13/293,556

(22) Filed: Nov. 10, 2011

(65) Prior Publication Data

US 2012/0118271 A1 May 17, 2012

(30) Foreign Application Priority Data

Nov. 12, 2010 (EP) ..... 10191097

(51) Int. Cl.
*F02M 57/02* (2006.01)
*F02D 41/20* (2006.01)
(Continued)

(52) U.S. Cl.
CPC ..... *F02D 41/20* (2013.01); *F02D 41/3845* (2013.01); *F02D 2041/2027* (2013.01); *F02D 2041/2037* (2013.01); *F02M 59/466* (2013.01); *F02M 63/0225* (2013.01)

(58) Field of Classification Search
CPC ..... F02D 2041/2027; F02D 2041/3845; F02D 2041/2037; F02D 2200/0602; F02D 2041/20; F02D 2041/3082; F02M 59/366; F02M 63/0225; F02M 59/466; F02M 37/08; F02M 57/027
USPC ..... 123/458, 457, 447, 446, 456, 495, 506, 123/497, 499
See application file for complete search history.

(56) References Cited

U.S. PATENT DOCUMENTS 5,975,053 A 11/1999 Rodier
6,193,212 B1 2/2001 Ohmi et al.
(Continued)

FOREIGN PATENT DOCUMENTS

DE 101 48 218 A1 4/2003
DE 10 2008 054 512 A1 6/2010
(Continued)

OTHER PUBLICATIONS

English translation of Chinese Office Action dated Dec. 4, 2013 (three (3) pages).
(Continued)

*Primary Examiner* — Hai Huynh
*Assistant Examiner* — Gonzalo Laguarda
(74) *Attorney, Agent, or Firm* — Crowell & Moring LLP

(57) ABSTRACT

The present invention relates to a method and an apparatus for controlling a high-pressure fuel supply pump configured to supply pressurized fuel to an internal combustion engine, with a solenoid-actuated intake valve being configured to be biased into a first direction towards a first stop position of the intake valve by means of a biasing force and being configured to be displaced against the biasing force into a second direction opposite to the first direction towards a second stop position of the intake valve by means of magnetic force and to be kept at the second stop position by means of magnetic force. The method includes applying control current to the solenoid-actuated intake valve for displacing the intake valve into the second direction to the second stop position and for keeping the intake valve at the second stop position during a first time period by means of magnetic force.

15 Claims, 17 Drawing Sheets

(51) Int. Cl.

| | |
|---|---|
| ***F02D 41/38*** | (2006.01) |
| *F02M 59/46* | (2006.01) |
| *F02M 63/02* | (2006.01) |

(56) References Cited

U.S. PATENT DOCUMENTS

| | | | | |
|---|---|---|---|---|
| 6,394,415 | B1 | 5/2002 | Ohmi et al. | |
| 6,701,898 | B2 * | 3/2004 | Tokuo et al. | 123/456 |
| 7,757,667 | B2 * | 7/2010 | Okamoto et al. | 123/499 |
| 8,418,677 | B2 * | 4/2013 | Okamoto | 123/512 |
| 2007/0089711 | A1 * | 4/2007 | Tokuo et al. | 123/446 |
| 2011/0288748 | A1 | 11/2011 | Richter et al. | |
| 2012/0118271 | A1 * | 5/2012 | Borg et al. | 123/495 |
| 2013/0032212 | A1 * | 2/2013 | Tokuo et al. | 137/1 |

FOREIGN PATENT DOCUMENTS

| | | | |
|---|---|---|---|
| JP | 2000-205076 | A | 7/2000 |
| JP | 2003-161226 | A | 6/2003 |
| WO | WO 02/095212 | A1 | 11/2002 |
| WO | WO 2007/090228 | A1 | 8/2007 |
| WO | WO 2010/066663 | A1 | 6/2010 |

OTHER PUBLICATIONS

Japanese Office Action dated Apr. 1, 2014 (two (2) pages).

Chinese Office Action dated Jul. 24, 2014, with English translation (ten (10) pages).

Chinese Office Action issued in counterpart Chinese Application No. 201110357014.5 dated Oct. 27, 2015 (two (2) pages).

* cited by examiner

METHOD AND CONTROL APPARATUS FOR CONTROLLING A HIGH-PRESSURE FUEL SUPPLY PUMP CONFIGURED TO SUPPLY PRESSURIZED FUEL TO AN INTERNAL COMBUSTION ENGINE

BACKGROUND OF THE INVENTION

1. Field of the Invention

The present invention relates to a method and a control apparatus for controlling a high-pressure fuel supply pump which is configured to supply pressurized fuel to an internal combustion engine, in particular to a common rail having a plurality of fuel injectors for injecting pressurized fuel into a combustion chamber of the internal combustion engine. Specifically, the present invention relates to a method and a control apparatus for controlling a high-pressure fuel supply pump which comprises a compression chamber, a normally-open-type solenoid-actuated intake valve for delivering unpressurized fuel to the compression chamber, a movable plunger reciprocating in the compression chamber between a first plunger position, e.g. the so-called bottom dead center position, and a second plunger position, e.g. the so-called top dead center position, for pressurizing fuel in the compression chamber, and a discharge valve for discharging pressurized fuel from the compression chamber to be supplied to the internal combustion engine. The normally-open-type solenoid-actuated intake valve of the high-pressure fuel supply pump is configured to be closed or kept closed by means of magnetic force. The present invention also relates to a computer program product comprising computer program code means configured to adapt a control apparatus.

2. Description of the Related Art

In recent years, gasoline direct injection (GDI) has become increasingly popular due to its advantages for increased power (due to a lower tendency to knock) and hence higher fuel efficiency. In gasoline direct injection, low-pressure fuel is delivered from the fuel tank by means of a low-pressure fuel pump to a high-pressure pump. In a compression chamber of the high-pressure pump, the low-pressure fuel is pressurized to high pressure and delivered to a common rail comprising a plurality of injectors for being directly injected at high pressure into a combustion chamber of the internal combustion engine.

In general, the amount of high-pressure fuel supplied by the high-pressure fuel supply pump is electronically controlled by controlling a solenoid-actuated intake valve of the high-pressure fuel supply pump. There are known normally-closed-type solenoid-actuated intake valves which can be opened and/or kept open by energizing one or more solenoids of the solenoid-actuated intake valve while being biased by one or more biasing members (such as e.g. springs) into a closing direction of the solenoid-actuated intake valve. Also, there are known normally-open-type solenoid-actuated intake valves which can be closed and/or kept closed by energizing one or more solenoids of the solenoid-actuated intake valve while being biased by one or more biasing members (such as e.g. springs) into an opening direction of the solenoid-actuated intake valve, the present invention relating to the latter normally-open-type solenoid-actuated intake valves.

Regarding high-pressure fuel supply pumps comprising normally-open-type solenoid-actuated intake valves, there are known two operation concepts for controlling the normally-open-type solenoid-actuated intake valves. According to a first-type operation concept as described in DE 10 2008 054 512 A1, the periodic operation cycle of the high-pressure fuel supply pump comprises firstly an intake period in which fuel is taken in through the intake valve into the compression chamber while a movable plunger moves in the compression chamber from a second plunder position (generally ref erred to as top dead center position) to a first plunger position (generally referred to as bottom dead center position) and the solenoid-actuated intake valve opens or is kept open by means of a biasing force, e.g. by a spring, during the intake period, secondly a spill period in which fuel is spilled out of the compression chamber through the intake valve while the movable plunger moves from the first plunger position to the second plunger position and the solenoid-actuated intake valve kept open by means of the biasing force or by means of the biasing force and hydraulic force of the fuel, and thirdly a delivery period in which fuel is pressurized in the compression chamber and discharged through a discharge valve of the high-pressure fuel supply pump to be supplied to the internal combustion engine while the movable plunger moves from the first plunger position to the second plunger position and the solenoid-actuated intake valve is kept closed by means of magnetic force.

According to the first-type operation concept, the normally-open solenoid actuated intake valve is kept closed until the movable plunger reaches the top dead center position by applying a control current to the solenoid-actuated intake valve, e.g. by applying a control voltage to the solenoid actuated intake valve. Then, after shutting off the control current when the movable starts its movement backwards towards the bottom dead center position, the normally-open intake valve opens due to the biasing force acting in the opening direction (possibly in combination with a hydraulic force generated by low-pressure fuel flowing through the intake valve into the compression chamber due to the increasing volume of the compression chamber while the movable plunger is moving towards the bottom dead center position). When the normally-open intake valve reaches a fully open position of the intake valve, an impact noise is generated which, especially for lower engine speeds such as e.g. the idle condition, will even dominate the overall noise of the engine.

For reducing the impact noise, when the normally-open intake valve reaches a fully open position, it is proposed in DE 10 2008 054 512 A1 to apply another pulse of control current to the solenoid-actuated intake valve after shutting off the control current in order to reduce the speed of the intake valve during the opening movement of the intake valve.

According to an alternative second-type operation concept as described in DE 101 48 218 A1, the periodic operation cycle of the high-pressure fuel supply pump comprises firstly an intake period in which fuel is taken in through the intake valve, if the intake valve is kept open during the intake period, or through an optionally provided auxiliary valve, if the intake valve is kept closed during the intake period by applying control current to the solenoid-actuated intake valve, into the compression chamber while the movable plunger moves from the second plunger position to the first plunger position, secondly a delivery period in which fuel is pressurized in the compression chamber and discharged through the discharge valve to be supplied to the internal combustion engine while the movable plunger moves from the first plunger position to the second plunger position and the solenoid-actuated intake valve is kept closed by means of magnetic force, and thirdly a spill period in which fuel is spilled out of the compression chamber through the intake valve while the movable plunger moves from the first plunder position to the second plunger position and the solenoid-actuated intake valve opens or is kept open by means of the biasing force.

According to the second-type operation concept, the normally-open solenoid actuated intake valve is kept closed until a time when the movable plunger moves towards but has not yet reached the top dead center position by applying a control current to the solenoid-actuated intake valve, e.g. by applying a control voltage to the solenoid actuated intake valve. Then, after shutting off the control current at a time in which the movable plunger still moves towards the top dead center position, the normally-open intake valve opens due to the biasing force acting in the opening direction (possibly in combination with a hydraulic force generated by pressurized fuel in the compression chamber due to the decreasing volume of the compression chamber while the movable plunger is moving towards the top dead center position). When the normally-open intake valve reaches a fully open position of the intake valve, an impact noise is generated which especially for lower engine speeds such as e.g. the idle condition will even dominate the overall noise of the engine.

For reducing the impact noise, when the normally-open intake valve reaches a fully open position, it is proposed in DP 101 48 218 A1 to apply another pulse of control current to the solenoid-actuated intake valve after shutting off the control current in order to reduce the speed of the intake valve during the opening movement, of the intake valve.

However, the teaching of DE 10 2008 054 512 A1 and DE 101 48 218 A1 of applying another pulse of control current of the solenoid-actuated intake valve after shutting off the control current suffers from the problem that the timing and the control current value of the pulse for reducing the speed of the opening movement has to be very accurately adjusted in order to actually help to reduce the noise of the operation of the high-pressure fuel supply pump. Specifically, if the timing of the pulse is too late or the control current value is too low, the pulse will be too late or too weak to reduce the speed of the opening movement so that the intake valve will nevertheless reach the fully open position at high speed and generate a loud impact noise.

On the other band, if the timing of the pulse is too early or the control current value is too high, the pulse may have a negative effect in that the speed of the opening movement of the intake valve may not be only reduced but stopped. It is even possible that the intake valve will, due to the pulse of control current, be closed again, possibly even up to the fully closed position (thereby possibly generating a noise when reaching the fully closed position) and after shutting off the control current of the pulse, the intake valve will start again moving in the opening direction due to the biasing force (and/or force) until it reaches the fully open position without any reduction in speed, thereby again having a high impact speed and generating a loud noise. Also, the valve will in such a situation reach the fully open position at a later time at which the movable plunger may have already an even higher movement speed depending on the cam profile. Then, the valve may even reach the fully open position at an even higher impact speed than without applying the deceleration pulse and even generate a louder impact noise.

In view of this problem, it is necessary to accurately adjust the pulse to the operating conditions such as the engine speed and the temperature of the fuel as well as to individual properties of the intake valve which can vary from one high-pressure fuel pump to another high-pressure fuel supply pump due to mass production deviations. For example, in DE 10 2008 05 512 A1, it is taught to use a cumbersome closed-loop control using a pressure sensor in order to be able to individually adjust the control of the pulse in accordance with the operating conditions such as the engine speed as well as in accordance with individual properties of the intake valve.

SUMMARY OF THE INVENTION

In view of the above-mentioned problems of the prior art, it is an object of the present invention to provide a method and a control apparatus for efficiently controlling a high-pressure fuel supply pump comprising a normally-open solenoid actuated intake valve with reduced noise, in particular while being less dependent on a precise calculation and on an accurate adjustment of the timing and the amplitude of a deceleration pulse.

For solving the above-mentioned object, a method for controlling a high-pressure fuel supply pump configured to supply pressurized fuel to an internal combustion engine according to claim 1, a control apparatus for controlling a high-pressure fuel supply pump configured to supply pressurized fuel to an internal combustion engine according to claim 14, and a computer program product according to claim 15 are proposed. The dependent claims relate to preferred embodiments of the present invention.

According to a first aspect of the present invention, a method for controlling a high-pressure fuel supply pump configured to supply pressurized fuel to an internal combustion engine, in particular to a common rail having a plurality of fuel injectors for injecting pressurized fuel into a combustion chamber of the internal combustion engine, is provided. The high-pressure fuel supply pump comprises a compression chamber, a solenoid-actuated intake valve for delivering unpressurized fuel to the compression chamber, a movable plunger reciprocating in the compression chamber between a first plunger position BPS and a second plunger position TDC for pressurizing fuel in the compression chamber, and a discharge valve for discharging pressurized fuel from the compression chamber to be supplied to the internal combustion engine, the solenoid-actuated intake valve being configured to be biased into a first direction towards a first stop position of the intake valve by means of a biasing force and being configured to be displaced against the biasing force into a second direction opposite to the first direction towards a second stop position of the intake valve by means of magnetic force and to be kept at the second stop position by means of magnetic force.

According to the first aspect, the method comprises applying control current to the solenoid-actuated intake valve for displacing the intake valve into the second direction to the second stop position and for keeping the intake valve at the second stop position during a first time period by means of magnetic force; and applying control current to the solenoid-actuated intake valve in a second time period after the first time period during a movement of the solenoid-actuated intake valve from the second stop position into the first direction. The first aspect of the present invention is characterized in that applying control current to the solenoid-actuated intake valve during the second time period comprises gradually decreasing the control current, in particular gradually decreasing the control current down to zero.

The present invention can be applied to normally-closed-type solenoid-actuated intake valves and normally-open-type solenoid-actuated intake valves. In particular, in case the solenoid-actuated intake valve is a normally-open-type solenoid-actuated intake valve being configured to be closed and/or kept closed by means of magnetic force, the first stop position is a fully open position of the solenoid-actuated intake valve, the first direction is an opening direction of the solenoid-actuated intake valve, the second stop position is a fully closed position of the solenoid-actuated intake valve and the second direction is a closing direction of the solenoid-actuated intake valve. On the other hand, in case the solenoid-actuated intake valve is a normally-closed-type solenoid-actuated intake valve being configured to be opened and/or kept open by means of magnet ic force, the first stop position is a fully closed position of the solenoid-actuated intake valve, the first direction is a closing direction of the solenoid-actuated intake valve, the second stop position is a fully open position of the solenoid-actuated intake valve and the second direction is an opening direction of the solenoid-actuated intake valve. In the following, preferred aspects of the present invention will be described in more detail in connection with normally-open-type solenoid-actuated intake valve being configured to be closed and/or kept closed by means of magnetic force. Also the preferred aspects can, however, be applied to the control of a normally-closed-type solenoid-actuated intake valve.

In case of a normally-open-type solenoid-actuated intake valve, according to the first aspect of the invention, a method for controlling a high-pressure fuel supply pump being configured to supply pressurized fuel to an internal combustion engine, in particular to a common rail having a plurality of fuel injectors for injecting pressurized fuel into a combustion chamber of the internal combustion engine, is provided. The high-pressure fuel supply pump comprises a compression chamber, a normally-open-type solenoid-actuated intake valve for delivering unpressurized fuel to the compression chamber, a movable plunger reciprocating in the compression chamber between a first plunger position, e.g. the so-called bottom dead center position, and a second plunger position, e.g. the so-called top dead center position, for pressurizing fuel in the compression chamber, and a discharge valve for discharging pressurized fuel from the compression chamber to be supplied to the internal combustion engine. The normally-open-type solenoid-actuated intake valve of the high-pressure fuel supply pump is configured to be closed or kept closed by means of magnetic force.

According to the present invention, the method for controlling the high-pressure fuel supply pump comprises applying, in particular after applying control current to the solenoid-actuated intake valve for closing the intake valve by means of magnetic force, control current to the solenoid-actuated intake valve for keeping the intake valve closed during a first time period by means of magnetic force while the movable plunger moves from the first plunger position, in particular the bottom dead center position, to the second plunger position, in particular the top dead center position. Here, pressurized fuel is discharged from the compression chamber through the discharge valve to be supplied to the internal combustion chamber while the movable plunger moves from the first plunger position to the second plunger position and the solenoid-actuated intake valve is kept closed by means of magnetic force and/or hydraulic force. Then, the method comprises applying control current to the solenoid-actuated intake valve in a second time period after the first time period during or even already before and during an opening movement of the solenoid-actuated intake valve, in particular in order to decelerate the opening movement of the intake valve or at least prevent acceleration of the opening movement of the solenoid-actuated intake valve. According to the invention, applying control current to the solenoid-actuated intake valve during the second time period comprises gradually (continuously or also iteratively/stepwise) decreasing the control current, preferably gradually (continuously or also iteratively/stepwise) decreasing the control current down to zero.

That is, after the first time period in which control current is applied for bringing the solenoid-actuated intake valve to the fully closed position and optionally keeping the solenoid-actuated intake valve closed, in another second time period, another pulse of control current is applied to the solenoid-actuated solenoid valve for reducing the acceleration and/or speed of the opening movement of the intake valve. However, according to the present invention, applying control current to the solenoid-actuated intake valve during the second time period comprises gradually decreasing the control current, in particular gradually decreasing the control current down to zero.

This has the advantage that the control current during the second time period can be initially applied at a high control current but is then controlled such that it is gradually reduced, thereby slowly decreasing the magnetic force acting in the closing direction of the intake valve. Accordingly, it is possible to slowly reduce the magnetic force so that the magnetic force will become automatically balanced with the biasing force acting in the opening direction of the intake valve so that the intake valve will slowly and smoothly be guided by the biasing force, which is slowly overcoming the slowly decreasing magnetic force, to the fully open position without generating an impact noise, substantially independent from the specific operating conditions such as the engine speed as well as substantially independent from individual properties of the intake valve e.g. due to mass production deviations. It is hence advantageously not required to provide an accurate adjustment and precise calculations regarding the specific operating conditions or the individual properties of the intake valve.

The term "opening movement of the solenoid-actuated intake valve" or "opening movement of the intake valve" refers to a movement of at least one part of the solenoid-actuated intake valve in the opening direction, of the intake valve, i.e. the direction of a movement of a valve member that can come in contact in a fully closed position with a valve seat for closing the valve. There are separate-type and integrated-type solenoid-actuated intake valve types. For integrated-type solenoid-actuated intake valves, the term "opening movement of the solenoid-actuated intake valve" or "opening movement of the intake valve" refers to an opening movement of the valve member which is typically fixed to or integrally formed with a valve rod that is itself fixed to or integrally formed with an anchor that can be attracted to or repelled from the energized solenoid. That is, for integrated-type solenoid-actuated intake valves, the term "opening movement of the solenoid-actuated intake valve" or "opening movement of the intake valve" may refer to an opening movement of the valve member, the valve rod and the anchor. However, for separated-type solenoid-actuated intake valves, the term "opening movement of the solenoid-actuated intake valve" or "opening movement of the intake valve" preferably refers to an opening movement of the anchor or another movable member that can be attracted to or repelled from the energized solenoid. The anchor is typically fixed to or integrally formed with the valve rod so that the term "opening movement of the intake valve" may refer to an opening movement of the anchor and the valve rod. According to a preferred embodiment of the present invention, applicable to normally-opentype solenoid-actuated intake valves and normally-closed-type solenoid-actuated intake valves, applying control current to the solenoid-actuated intake valve is controlled by means of pulse-width modulation (PWM) control by applying a pulse-width modulation voltage signal to the solenoid-actuated intake valve, and gradually decreasing the control current value comprises stepwise (iteratively) decreasing a duty cycle of the applied pulse-width modulation voltage signal, e.g. according to a stepped-down pulse width modulation control. Accordingly, it is efficiently possible to gradually decrease the control current during the second time period by stepwise (iteratively) decreasing the duty cycle of an applied PWM control voltage, e.g. by controlling the duty cycle of the applied PWM control voltage such that the duty cycle is decreased according to a decreasing step function.

Alternatively, according to yet another preferred embodiment of the present invention, applicable to normally-open-type solenoid-actuated intake valves and normally-closed-type solenoid-actuated intake valves, applying control current to the solenoid-actuated intake valve is controlled by means of pulse-width modulation control by applying a pulse-width modulation voltage signal to the solenoid-actuated intake valve, and gradually decreasing the control current value comprises continuously decreasing a duty cycle of the applied pulse-width modulation voltage signal, e.g. according to a ramped-down pulse width modulation control. Accordingly, it is efficiently possible to gradually decrease the control current during the second time period by continuously decreasing the duty cycle of an applied PWM control voltage, e.g. by controlling the duty cycle of the applied PWM control voltage such that the duty cycle is decreased according to a monotonic decreasing function, e.g. a linearly decreasing function.

According to a first-type operation concept of a normally-open-type solenoid-actuated intake valve, the operation of the high-pressure fuel supply pump preferably comprises an intake period in which fuel is taken in through the intake valve into the compression chamber while the movable plunger moves from the second plunger position to the first plunger position and the solenoid-actuated intake valve opens or is kept open by means of a biasing force or by means of a biasing force of a biasing force and a hydraulic force during the intake period, a spill period in which fuel is spilled out of the compression chamber through the intake valve while the movable plunger moves from the first plunger position to the second plunger position and the solenoid-actuated intake valve is kept open by means of a biasing force, and a delivery period in which fuel is pressurized in the compression chamber and discharged through the discharge valve to be supplied to the internal combustion engine while the movable plunger moves from the first plunger position to the second plunger position and the solenoid-actuated intake valve is kept closed by means of magnetic force.

That is, according to the first-type operation concept, the intake period is followed by the spill period which is followed by the delivery period until the cycle is continued again with the intake period. Specifically, during the time in which the movable plunger moves from the first plunger position to the second plunger position, the spill period substantially begins when the movable plunger starts at the first plunger position, the intake valve is closed during the movement of the movable plunger from the first plunger position to the second plunger position and as soon as the intake valve is closed, the delivery period starts and fuel is delivered through the discharge valve substantially until the movable plunger arrives at the second plunger position.

When the high-pressure fuel supply pump according to the first-type operation concept is controlled, the second time period is preferably comprised in the intake period.

According to an alternative second-type operation concept of a normally-open-type solenoid-actuated intake valve, the operation of the high-pressure fuel supply pump comprises an intake period in which fuel is taken in through the intake valve, if the intake valve is kept open during the intake period, or through an optionally provided auxiliary valve, if the intake valve is kept closed during the intake period by applying control current to the solenoid-actuated intake valve, into the compression chamber while the movable plunger moves from the second plunger position to the first plunger position, a delivery period in which fuel is pressurized in the compression chamber and discharged through the discharge valve to be supplied to the internal combustion engine while the movable plunger moves from the first plunger position to the second plunger position and the solenoid-actuated intake valve is kept closed by means of magnetic force, and a spill period in which fuel is spilled out of the compression chamber through the intake valve while the movable plunger moves from the first plunger position to the second plunger position and the solenoid-actuated intake valve opens or is kept open by means of a biasing force or by means of a biasing force and a hydraulic force.

That is, according to the second-type operation concept, the intake period is followed by the delivery period which is followed by the spill period until, the cycle is continued again with the intake period. Specifically, during the time in which the movable plunger moves from the first plunger position to the second plunger position, the delivery period substantially begins when the movable plunger starts at the first plunger position (or at least soon after the start of the movement towards the second plunger position), the intake valve is initially closed during the movement of the movable plunger from the first plunger position towards the second plunger position and as soon as the intake valve is opened, the spill period starts and fuel is spilled through the intake, valve substantially until the movable plunger arrives at the second plunger position.

When the high-pressure fuel supply pump according to the second-type operation concept is controlled, the second time period is preferably comprised in the spill period. According to a preferred embodiment, applicable to normally-open-type solenoid-actuated intake valves and normally-closed-type solenoid-actuated intake valves, the control current to the solenoid-actuated intake valve is applied during the second time period such that an acceleration of the movement of the intake valve into the first direction is prevented, in particular prior to a time at which the intake valve reaches the first stop position.

According to another preferred embodiment, applicable to normally-open-type solenoid-actuated intake valves and normally-closed-type solenoid-actuated intake valves, the control current to the solenoid actuated-intake valve is applied during the second time period such that the movement of the intake valve into the first directions decelerated, in particular prior to a time at which the intake valve reaches the first stop position. Preferably, applicable to normally-open-type solenoid-actuated intake valves and normally-closed-type solenoid-actuated intake valves, control current is applied to the solenoid actuated-intake valve in the second time period at least until the intake valve reaches the first stop position. In particular, the control current is preferably gradually decreased such that it reaches zero after the intake valve reaches the first stop position.

According to a preferred embodiment, applicable to normally-open-type solenoid-actuated intake valves, in particular for the above-mentioned first-type operation concept, control current in the second time period is applied to the solenoid actuated-intake valve after the movable plunger has reached the second plunger position. Alternatively, control current in the second time period can be applied to the solenoid actuated-intake valve already substantially at a time at which the movable plunger reaches the second plunger position.

Preferably, applicable to normally-open-type solenoid-actuated intake valves and normally-closed-type solenoid-actuated intake valves, the first and second time periods are separated by a third time period in which no control current is applied to the solenoid-actuated intake valve. Preferably, applicable to normally-open-type solenoid-actuated intake valves, in particular for the above-mentioned first-type operation concept, the third time period comprises the time at which the movable plunger reaches the second plunger position. This has the advantage that the energy consumption of the high-pressure fuel supply pump can be reduced and thermal overload can be avoided since there is no control current applied to the solenoid-actuated intake valve during the third time period between the first and the second time periods. For the first-type operation concept mentioned above, this means than the control current can be for example even already shut off before the movable plunger has reached the second plunger position. Then, the increasing hydraulic pressure inside the compression chamber can be used for keeping the intake valve closed until the movable plunger reaches the second plunger position. According to another preferred embodiment, applicable to normally-open-type solenoid-actuated intake valves and normally-closed-type solenoid-actuated intake valves, the control current is continuously applied to the solenoid-actuated intake valve from the first time period to the second time period. Then, the first time period and the second time period may be preferably separated by a third time period in which control current is applied to the solenoid-actuated intake valve, the control current applied during the third time period being preferably smaller than the control current applied in the first time period for keeping the intake valve closed. Also this has the advantage that the energy consumption of the high-pressure fuel supply pump can be reduced and thermal overload can be avoided since there is lower control current applied to the solenoid-actuated intake valve during the third time period between the first and the second time periods. For the first-type operation concept mentioned above, applicable to normally-open-type solenoid-actuated intake valves, this means that the control current can for example be reduced before the movable plunger has reached the second plunger position. Then, the increasing hydraulic pressure inside the compression chamber can be used for keeping the intake valve closed until the movable plunger reaches the second plunger position. Preferably, the control current applied during the first time period is larger than the control current applied in the second time period. Preferably, in case of a normally-open-type solenoid-actuated intake valve, the control current applied during the first time period for bringing the intake valve to the fully closed position and optionally keeping the intake valve closed is larger than the control current applied in the second time period.

Preferably, applicable to normally-open-type solenoid-actuated intake valves and normally-closed-type solenoid-actuated intake valves, applying control current to the solenoid-actuated intake valve in the second time period is only performed during a low-load operation of the internal combustion engine, in particular during an idle operation of the internal combustion engine. At higher engine speeds, the high-pressure fuel supply pump may be operated without control current being applied after the first time period in which current is applied for keeping the intake valve closed. The reason is that for higher engine speeds, other noise sources such as the engine noise will become dominant to the overall noise and the impact noise generated when the intake valve reaches the fully open position does not significantly contribute to the overall operation noise.

Preferably, applicable to normally-open-type solenoid-actuated intake valves and normally-closed-type solenoid-actuated intake valves, the control current applied to the solenoid-actuated intake valve as controlled by means of pulse-width modulation control of an applied voltage signal, in particular during the second time period according to a stepped-down PWM control with stepwise (iteratively) decreasing duty cycle or a ramped-down PWM control with continuously decreasing duty cycle as mentioned above, or, according to another preferred embodiment of the present invention, the control current applied to the solenoid-actuated intake valve is controlled by means of closed-loop current control, e.g. by current threshold control using the feedback from a solenoid-current sensing. Such a current control may involve controlling a control current value of the solenoid-actuated intake valve by means of a current amplifier and determining a control current value of the solenoid-actuated intake valve by means of a current sensor. In particular, any method of controlling the control current of a solenoid actuated intake valve may be used as long as the step of applying control current during the second time period comprises gradually reducing the control current.

Preferably, applicable to normally-open-type solenoid-actuated intake valves and normally-closed-type solenoid-actuated intake valves, the intake valve is an integrated-type intake valve comprising a valve member and a valve, rod, the valve member and the valve rod being formed from an integrally formed piece or the valve member and the valve rod being fixed to each other. Alternatively, applicable to normally-open-type solenoid-actuated intake valves and normally-closed-type solenoid-actuated intake valves, the intake valve may be a separate-type intake valve comprising a valve member and a valve rod being formed separately.

According to a second aspect of the present invention, a control apparatus for controlling a high-pressure fuel supply pump configured to supply pressurized fuel to an internal combustion engine is provided, the control apparatus being adapted to control a control current applied to the solenoid actuated intake valve according to a method for controlling a high-pressure fuel supply pump according to the above-mentioned method according to the first aspect of the present invention or at least one of the above-mentioned preferred embodiments thereof.

According to a third aspect of the present invention, a computer program product comprising computer program code means is provided, the computer program code means being configured to adapt a control apparatus, in particular an engine control unit, such that the control apparatus is adapted to control a control current applied to the solenoid actuated intake valve according to a method for controlling a high-pressure fuel supply pump according to the above-mentioned method according to the first aspect of the present invention or at least one of the above-mentioned preferred embodiments thereof.

DETAILED DESCRIPTION OF THE PREFERRED EMBODIMENTS

Preferred embodiments of the present invention will be described below with reference to the figures. It is to be noted that the described features and aspects of the embodiments may be modified or combined to form further embodiments of the present invention. In this description, either of the two current control methods (direct, current threshold control using feedback from solenoid-current sensing or PWM control) will be used to describe the ideas contained herein (i.e., either by showing the desired resulting current or by showing the PWM signal which could generate such a current). However, it should be noted that any implementation for controlling a current control can be used. Furthermore, please note that the actual current profile may exhibit other features, such as current ripples (especially with PWM control) or a dip in the current when the intake valve impacts the mechanical stops. Such features are omitted in the figures for simplicity, and only the local mean current is displayed (as a smooth trace).

Figure 1:
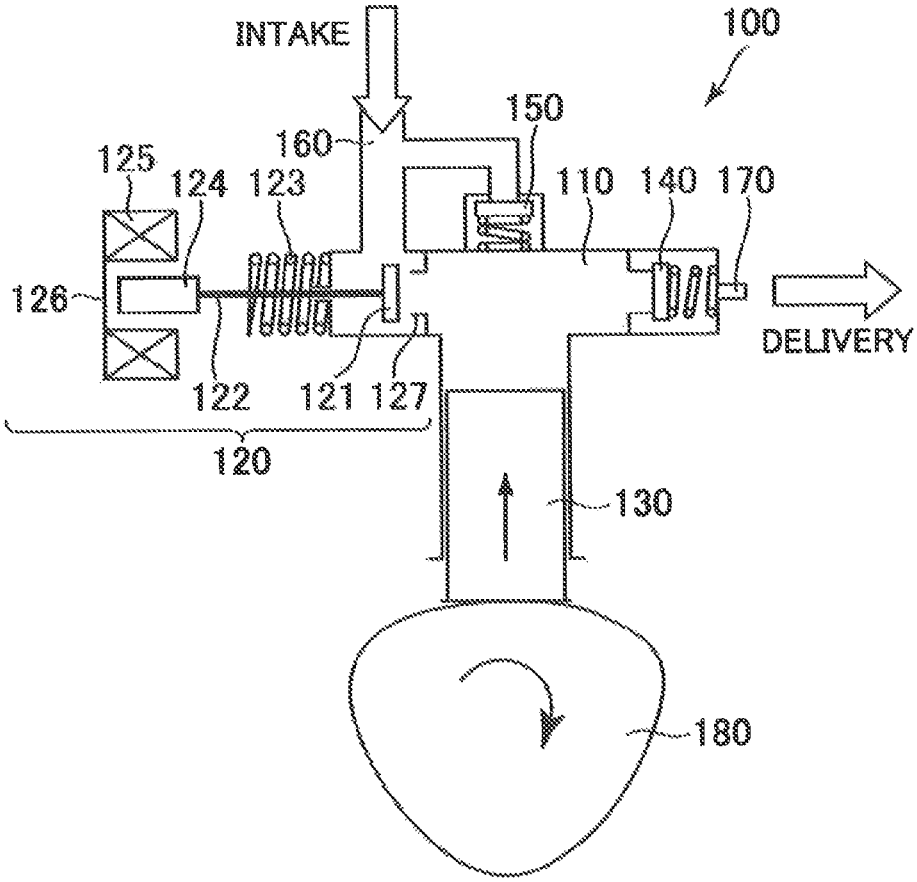
FIG. 1 shows an example of a high-pressure fuel supply pump comprising an integrated-type normally-open solenoid actuated intake valve which can be controlled according to the second-type operation (based on FIG. 4 of DE 101 48 218 A1).

FIG. 1 shows an example of a high-pressure fuel supply pump 100 comprising an integrated-type normally-open solenoid-actuated intake valve 120 which can be controlled according to the second-type operation. The high-pressure fuel supply pump 100 comprises a compression chamber 110, a movable plunger 130 driven by a cam 180 and reciprocating in the compression chamber 110 between a bottom dead center position and a top dead center position. Besides the solenoid actuated intake valve 120, the high-pressure fuel supply pump 100 further comprises an auxiliary valve 150 for delivering low-pressure fuel from an intake passage 160 to the compression chamber 110 and a discharge valve 140 for delivering high-pressure fuel from the compression chamber 110 to a discharge passage 170 connected with a common rail of a combustion engine (not shown).

The solenoid-actuated intake valve 120 is an integrated-type intake valve, comprising a valve member 121 fixed to a valve rod 122. The valve rod 122 is biased by a spring 123 to an opening direction of the valve 121. The solenoid-actuated intake valve 120 further comprises a anchor 124 fixed to the valve rod 122 and a solenoid coil 125, wherein the anchor 124 can come in contact with a restricting member 126 in the fully open position of the intake valve. When applying a control current to the solenoid coil 125, a magnetic biasing force is generated acting on the anchor 124 in a closing direction of the intake valve so that the intake valve can be closed by applying a control current until the valve member 121 comes in contact with a valve seat 127 in a fully closed position of the intake valve.

When the cam 180 rotates, the operation of the high-pressure fuel supply pump 100 comprises an intake period in which fuel is taken in through the intake valve 120 through the auxiliary valve 150 while the intake valve 120 is kept closed during the intake period by applying control current to the solenoid-actuated intake valve 120 into the compression chamber 110 while the movable plunger 130 moves from the top dead center position TDC to the bottom dead center position BDC, a delivery period in which fuel is pressurized in the compression chamber 110 and discharged through the discharge valve 140 to be supplied to the internal combustion engine while the movable plunger 130 moves from the bottom dead center position BDC to the top dead center position. TDC and the solenoid-actuated intake valve 120 is kept closed by means of magnetic force, and a spill period in which fuel is spilled out of the compression chamber 110 through the intake valve 120 while the movable plunger 130 moves from the bottom dead center position BDC to the top dead center position TDC and the solenoid-actuated intake valve 120 opens or is kept open by means of a biasing force by the spring 123 and possibly hydraulic force of fuel spilling out through the intake valve 120 (second-type operation; please also refer to FIG. 5). In the above, the intake valve is kept closed during the intake period and low-pressure fuel is only delivered to the compression chamber 110 via the auxiliary valve 150. However, the intake valve 120 can also be controlled such that at least in a part of the intake period, low-pressure is delivered to the compression chamber 110 through the intake valve 120 and the auxiliary valve 150 or only through the intake valve 120 in case there is not provided any auxiliary valve 150. The intake valve 120 is controlled to be closed the latest at the end of the intake period.

Figure 2:
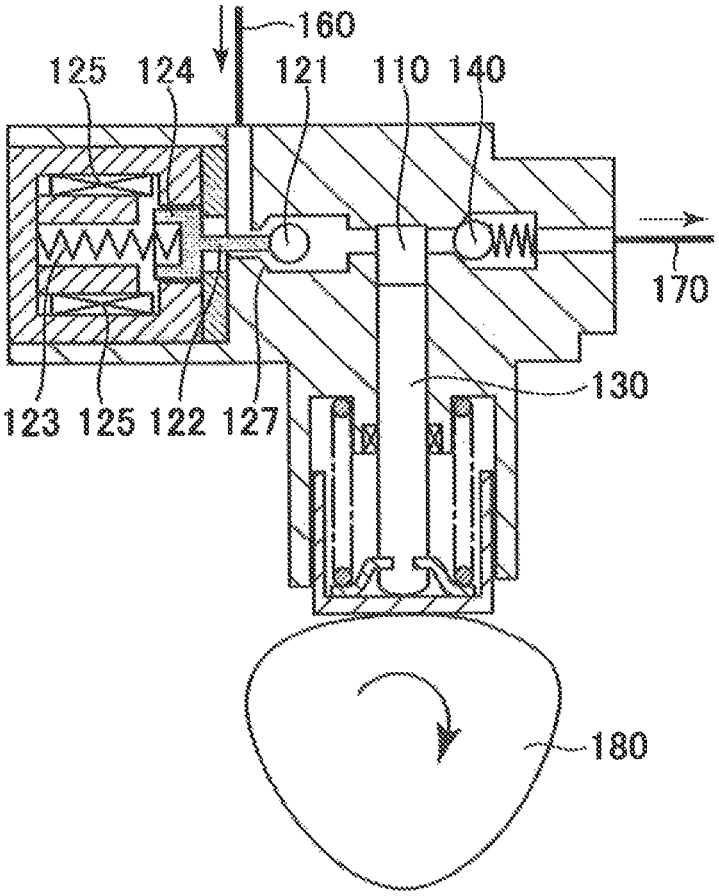
FIG. 2 shows an example of a high-pressure fuel supply pump comprising an integrated-type normally-open solenoid actuated intake valve which can be controlled according to the first-type operation.

FIG. 2 shows an example of a high-pressure fuel supply pump 100 comprising an integrated-type normally-open solenoid-actuated intake valve 120 which can be controlled according to the first-type operation. The high-pressure fuel supply pump 100 comprises a compression chamber 110 a movable plunger 130 driven by a cam 180 and reciprocating in the compression chamber 110 between a bottom dead center position and a top dead center position. Besides the solenoid actuated intake valve 120, the high-pressure fuel supply pump 100 further comprises a discharge valve 140 for delivering high-pressure fuel from the compression chamber 110 to a discharge passage 170 connected with a common rail of a combustion engine (not shown).

The solenoid-actuated intake valve 120 is an integrated-type intake valve comprising a valve member 121 fixed to a valve rod 122. The valve rod 122 is biased by a spring 123 to an opening direction of the valve 121. The solenoid-actuated intake valve 120 further comprises a anchor 124 fixed to the valve rod 122 and a solenoid coil 125. When applying a control current to the solenoid coil 125, a magnetic biasing force is generated acting on the anchor 124 in a closing direction of the intake valve so that the intake valve can be closed by applying a control current until the valve member 121 comes in contact with a valve seat 127 in a fully closed position of the intake valve.

Figure 4:
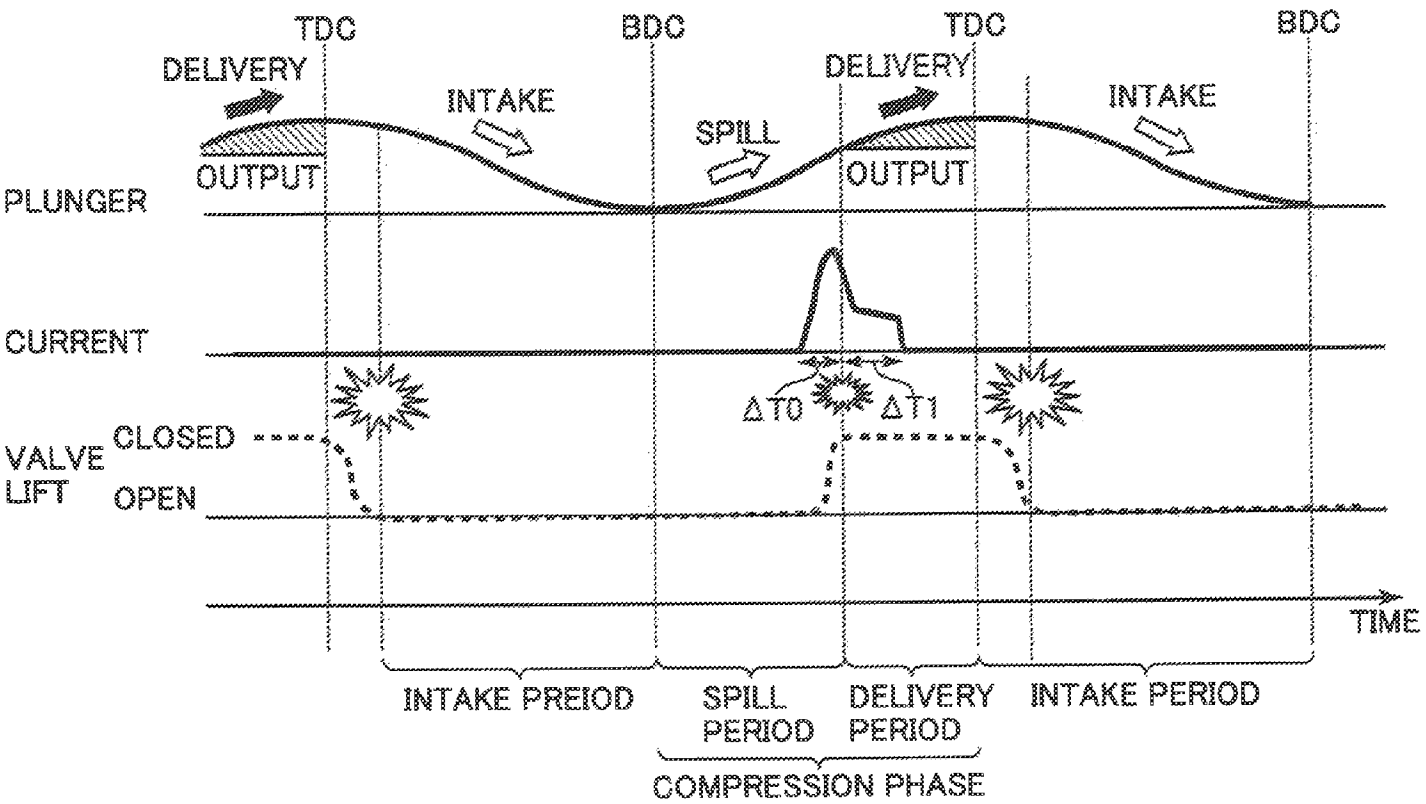
FIG. 4 exemplarily illustrates the control of an integrated-type solenoid-actuated intake valve according to the first-type operation of a high-pressure fuel supply pump.

When the cam 130 rotates, the operation of the high-pressure fuel supply pump 100 comprises an intake period in which fuel is taken in through the intake valve 120 into the compression chamber 110 while the movable plunger 130 moves from the top dead center position TDC to the bottom dead center position BDC and the solenoid-actuated intake valve 120 opens or is kept open by means of the biasing force of the spring 123, a spill period in which fuel is spilled out of the compression chamber 110 through the intake valve 120 while the movable plunger 130 moves from the bottom dead center position BDC to the top dead center position TDC and the solenoid-actuated intake valve 120 is kept open by means of the biasing force, and a delivery period in which fuel is pressurized in the compression chamber 110 and discharged through the discharge valve 140 to be supplied to the internal combustion engine while the movable plunger 130 moves from the bottom dead center position BDC to the top dead center position TDC and the solenoid-actuated intake valve 120 is kept closed by means of magnetic force (first-type operation; please also refer to FIG. 4).

Figure 3:
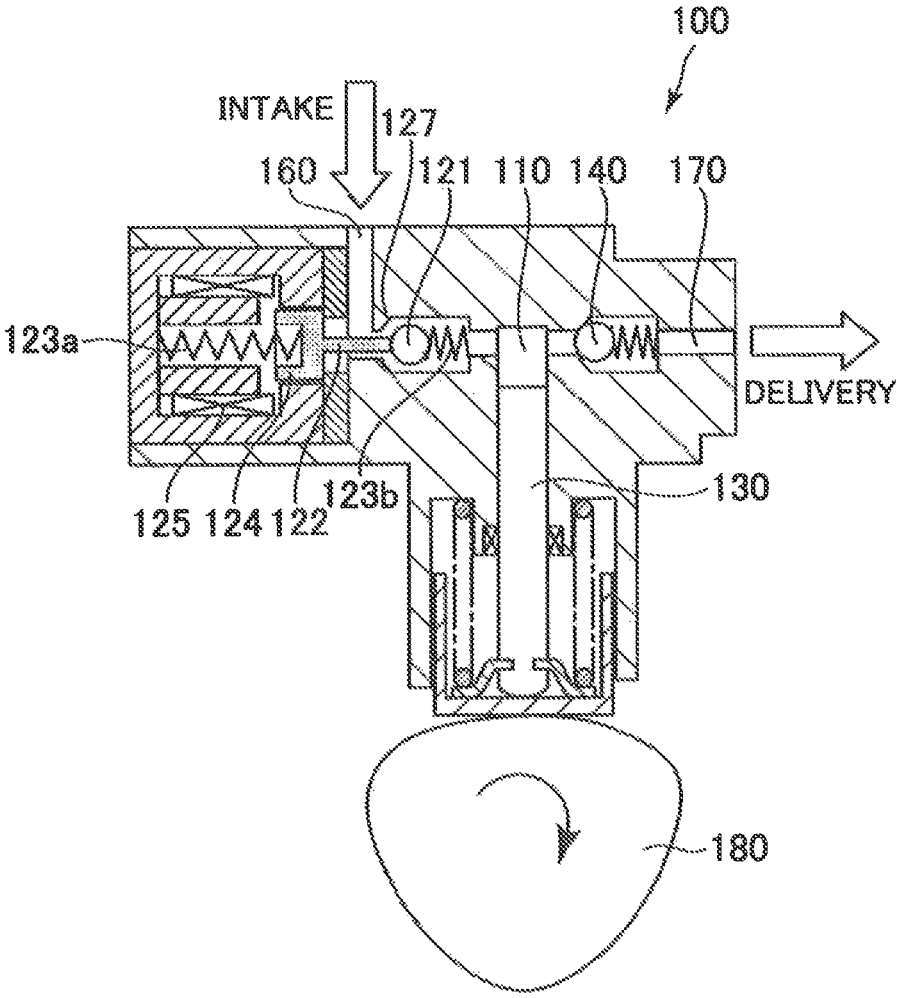
FIG. 3 shows an example of a high-pressure fuel supply pump comprising a separate-type normally-open solenoid actuated intake valve which can be controlled according to the first-type operation.

FIG. 3 shows an example of a high-pressure fuel supply pump 100 comprising a separate-type normally-open solenoid actuated intake valve 120 which can be controlled according to the first-type operation. Different to the high-pressure fuel supply pump 100 shown in FIG. 2, the valve rod 122 and the valve member 121 are separate bodies. The valve member 121 is biased by a spring 123*b* to a closing direction of the intake valve 120 and the valve rod 122 is biased by a spring 123*a* to an opening direction of the intake valve 120, the biasing force of the spring 123*a* being stronger than the biasing force of the spring 123*b* so that the valve member 121 is biased by the valve rod 122 to the opening direction of the intake valve when no control current is applied to the solenoid coil 125. By applying control current to the solenoid coil 125, a magnetic force acting on the anchor 124 is generated attracting the anchor 124 together with the valve rod 122 so that the valve member 121 can come in contact with the valve seat 127 in the fully closed position of the intake valve 120. The operation of the separate-type normally-open solenoid-actuated intake valve 120 shown in FIG. 3 is basically similar to the operation of the solenoid-actuated intake valve 120 shown in FIG. 2 in that the intake period is followed by the spill period which is then followed by the delivery period (first-type operation).

FIG. 4 exemplarily illustrates the control of a solenoid-actuated intake valve according to the first-type operation of a high-pressure fuel supply pump. The upper row in FIG. 4 illustrates the plunger movement of the movable plunger 130 reciprocating between the bottom dead center position BDC and the top dead center position TDC. The middle row in FIG. 4 illustrates the control current applied to the solenoid coil 125 and the lower row in FIG. 4 illustrates the movement of the intake valve 120, in particular the valve member 121, between the fully open position and the fully closed position.

Figure 5:
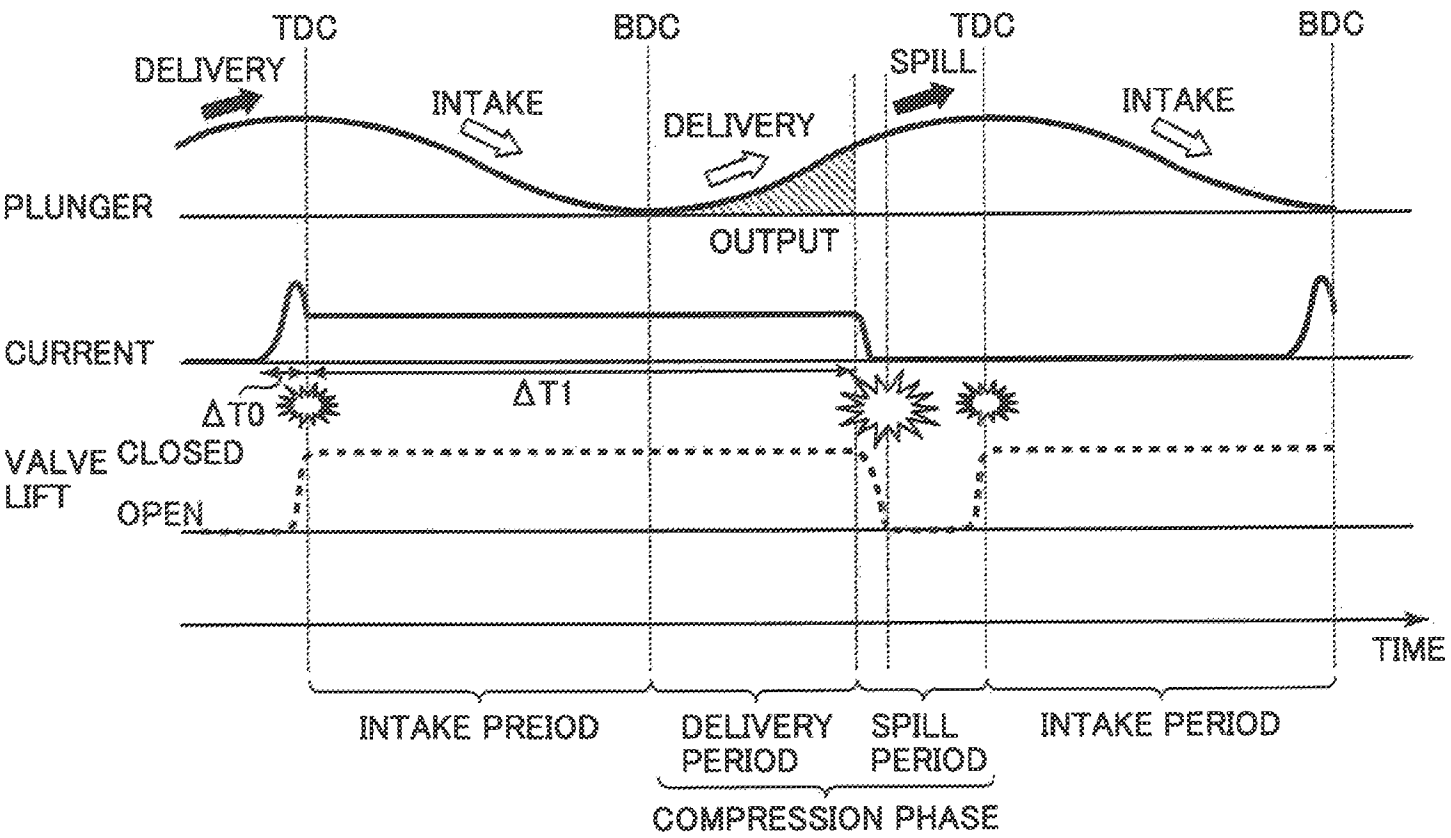
FIG. 5 exemplarily illustrates the control of an integrated-type solenoid-actuated intake valve according to the second-type operation of a high-pressure fuel supply pump.

When the movable plunger 130 moves from the bottom dead center position BDC towards the top dead center position TDC, the intake valve 120 is closed by applying a high control current pulse to the solenoid 125 during a time period $\Delta T0$ for energizing the solenoid 125 and closing the intake valve 120. Then, when the intake valve 120 is in the fully closed position, a control current is applied during a first time period $\Delta T1$ for keeping the intake valve 120 closed. Thereafter, the control current is shut off for reasons of energy consumption, wherein the intake valve 120 is kept closed by hydraulic force caused by the increasing pressure in the compression chamber 110. When the movable plunger 130 reaches the top dead center position, the intake valve 120 is opened by the biasing force of the spring (spring 123 in FIG. 2 or spring 123*a* in FIG. 3) and also possibly by hydraulic force being generated by low-pressure fuel flowing in the compression chamber 110 through the opening intake valve 120. When the intake valve 120 reaches the fully open position, a loud impact noise is generated. FIG. 5 exemplarily illustrates the control of a solenoid-actuated intake valve according to the second-type operation of a high-pressure fuel supply pump. The upper row in FIG. 5 illustrates the plunger movement of the movable plunger 130 reciprocating between the bottom dead center position BDC and the top dead center position TDC. The middle row in FIG. 5 illustrates the control current applied to the solenoid coil 125 and the lower row in FIG. 5 illustrates the movement of the intake valve 120, in particular the valve member 121, between the fully open position and the fully closed position.

When the movable plunger 130 moves from the bottom dead center position BDC towards the top dead center position TDC, the intake valve 120 is at first kept closed in the fully closed position by applying a control current being lower than the initial pulse, which was applied during the time period $\Delta T0$ ($\Delta T0$ can also be set later than shown in FIG. 5; then, low-pressure fuel can be delivered to the compression chamber 150 at the beginning of the intake phase through both valves, the intake valve 120 and the auxiliary valve 150), during a first time period $\Delta T1$ for keeping the intake valve 120 closed. Thereafter, the control, current is shut off and the intake valve 120 is opened by the biasing force of the spring (spring 123 in FIG. 1) and also possibly by hydraulic force being generated by fuel flowing out from the compression chamber 110 through the opening intake valve 120. When the intake valve 120 reaches the fully open position, a loud impact noise is generated.

Figure 6:
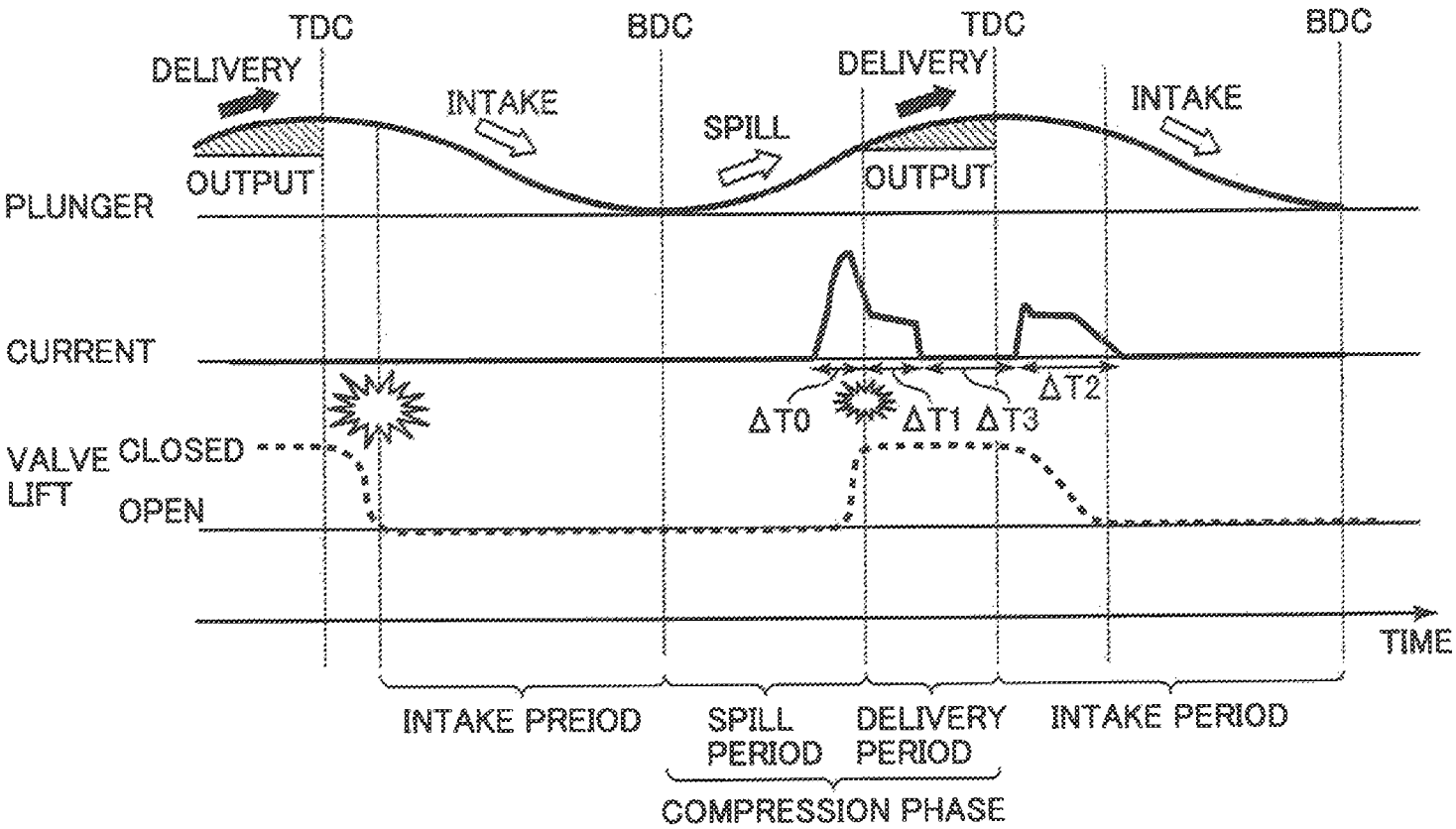
FIG. 6 exemplarily illustrates the control of an integrated-type solenoid-actuated intake valve according to a first embodiment of the present invention.

FIG. 6 exemplarily illustrates the control of a solenoid-actuated intake valve according to a first embodiment of the present invention. The upper row in FIG. 6 illustrates the plunger movement of the movable plunger 130 reciprocating between the bottom dead center position BDC and the top dead center position TDC. The middle row in FIG. 6 illustrates the control current applied to the solenoid coil 125 and the lower row in FIG. 6 illustrates the movement of the intake valve 120, in particular the valve member 121, between the fully open position and the fully closed position.

The basic control, principle in FIG. 6 is similar to the control principle described with reference to FIG. 4, however, in accordance with the first embodiment of the present invention, after the movable plunger 130 has reached the top dead center position TDC and is moving again towards the bottom dead center position. EDC, control current is applied again to the solenoid 125 during a second time period ΔT2. During a third time period ΔT3 between the first and second time periods ΔT1 and ΔT2, no control current is applied. Specifically, during the second time period ΔT2, a deceleration current impulse is applied to the solenoid 125 by first energizing the solenoid 125 quickly by increasing the control current to a maximal deceleration pulse current control value which may be substantially of the same amplitude as the control current applied during the first time period ΔT1 (as shown in the FIG. 6) or not. The control current is for a short time period kept substantially at the maximal deceleration pulse current control value before it is gradually reduced down to zero, in particular substantially linearly decreased down to zero. As a consequence, the opening movement of the intake, valve can be decelerated and due to the gradually decreasing control current value, the intake valve 120 smoothly reaches the fully open position without generating a significant impact noise.

Figure 7:
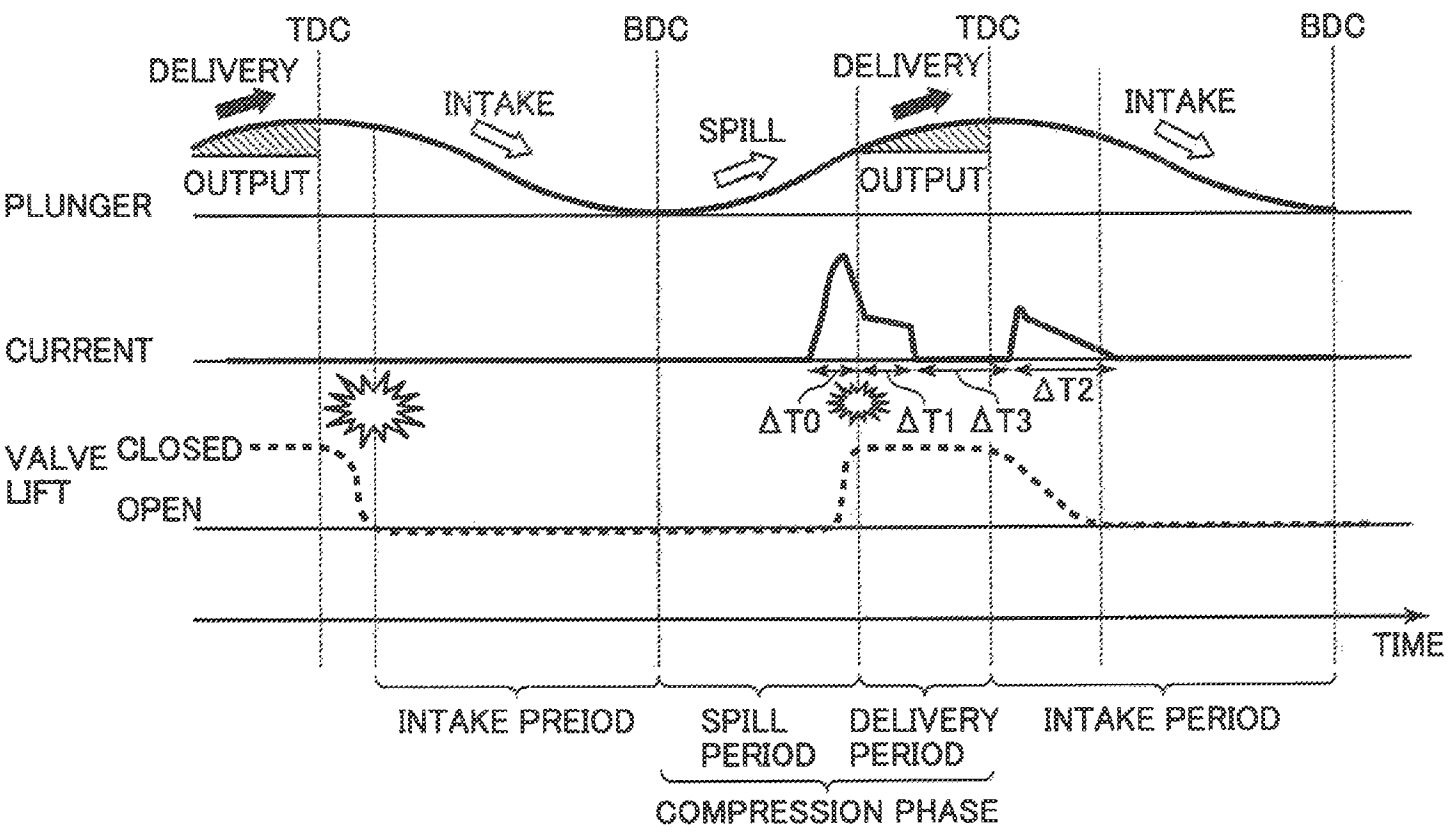
FIG. 7 exemplarily illustrates the control of an integrated-type solenoid-actuated intake valve according to a second embodiment of the present invention.

FIG. 7 exemplarily illustrates the control of a solenoid-actuated intake valve according to a second embodiment of the present invention. The upper row in FIG. 7 illustrates the plunger movement of the movable plunger 130 reciprocating between the bottom dead center position BDC and the top dead center position TDC. The middle row in FIG. 7 illustrates the control current applied to the solenoid coil 125 and the lower row in FIG. 7 illustrates the movement of the intake valve 120, in particular the valve member 121, between the fully open position and the fully closed position.

The basic control principle in FIG. 7 is similar to the control principle described with reference to FIG. 4, however, in accordance with the second embodiment of the present invention, after the movable plunger 130 has reached the top dead center position TDC and is moving again towards the bottom dead center position BDC, control current is applied again to the solenoid 125 during a second time period ΔT2. Specifically, during the second time period ΔT2, a deceleration current impulse is applied to the solenoid 125 by first energizing the solenoid 125 quickly by increasing the control current to a maximal deceleration pulse current control value which may be substantially of the same amplitude as the control current applied during the first time period ΔT1 (as shown in the FIG. 7) or not. The control current is then directly gradually reduced down to zero, in particular substantially linearly decreased down to zero. As a consequence, the opening movement of the intake valve can be decelerated and due to the gradually decreasing control current value, the intake valve 120 smoothly reaches the fully open position without generating a significant impact noise.

Figure 8:
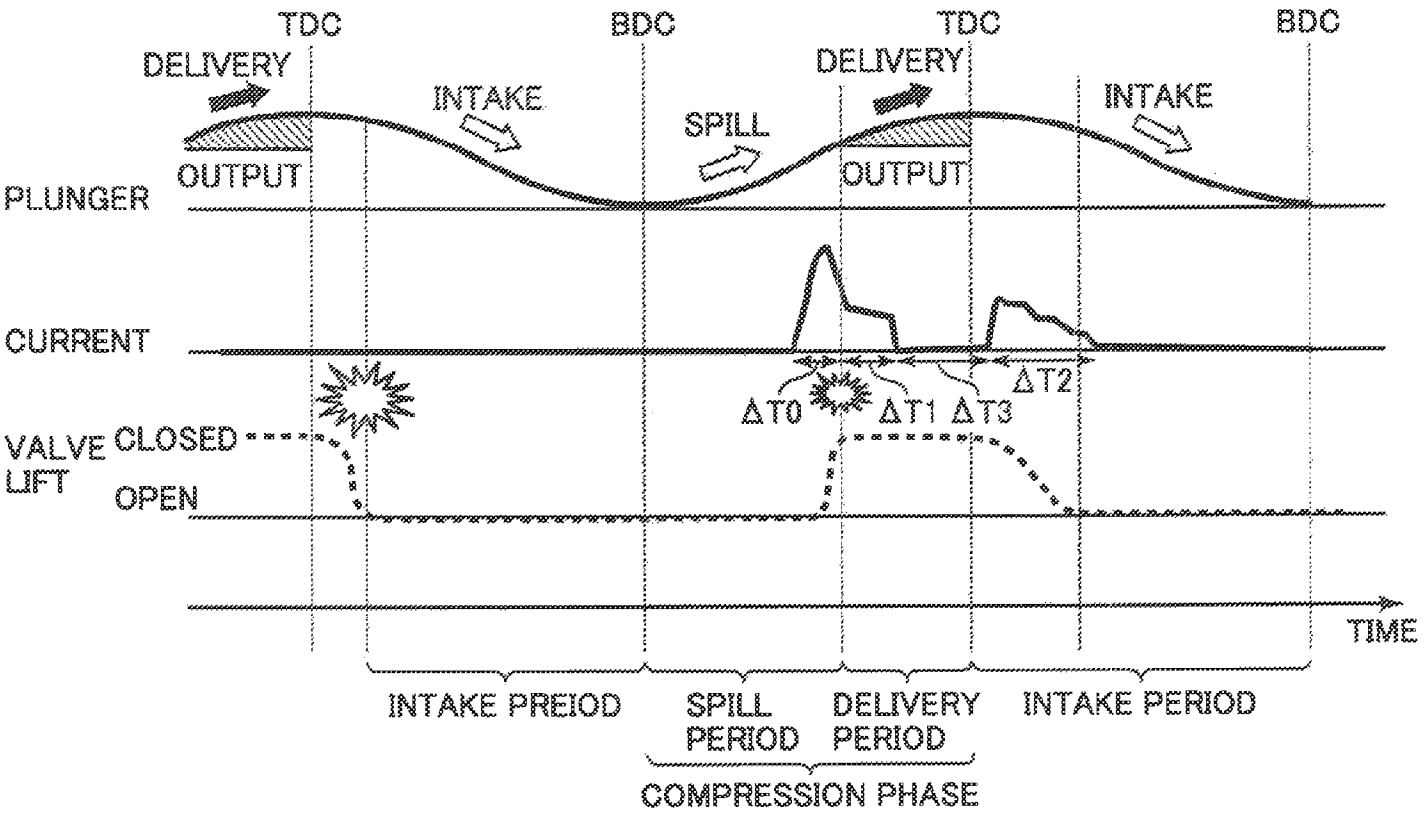
FIG. 8 exemplarily illustrates the control of an integrated-type solenoid-actuated intake valve according to a third embodiment of the present invention.

FIG. 8 exemplarily illustrates the control of a solenoid-actuated intake valve according to a third embodiment of the present invention. The upper row in FIG. 8 illustrates the plunger movement of the movable plunger 130 reciprocating between the bottom dead center position BDC and the top dead center position TDC. The middle row in FIG. 8 illustrates the control current applied to the solenoid coil 125 and the lower row in FIG. 2 illustrates the movement of the intake valve 120, in particular the valve member 121, between the fully open position and the fully closed position.

The basic control principle in FIG. 8 is similar to the control principle described with reference to FIG. 4, however, in accordance with the third embodiment of the present invention, after the movable plunger 130 has reached the top dead center position TDC and is moving again towards the bottom dead center position BDC, control current is applied again to the solenoid 125 during a second time period ΔT2. Specifically, during the second time period ΔT2, a deceleration current impulse is applied to the solenoid 125 by first energizing the solenoid 125 quickly by increasing the control current to a maximal deceleration pulse current control value which may be substantially of the same amplitude as the control current applied during the first time period ΔT1 (as shown in the FIG. 8) or not. The control current is then directly gradually reduced down to zero. As a consequence, the opening movement of the intake valve can be decelerated and due to the gradually decreasing control current value, the intake valve 120 smoothly reaches the fully open position without generating a significant impact noise.

Figure 9:
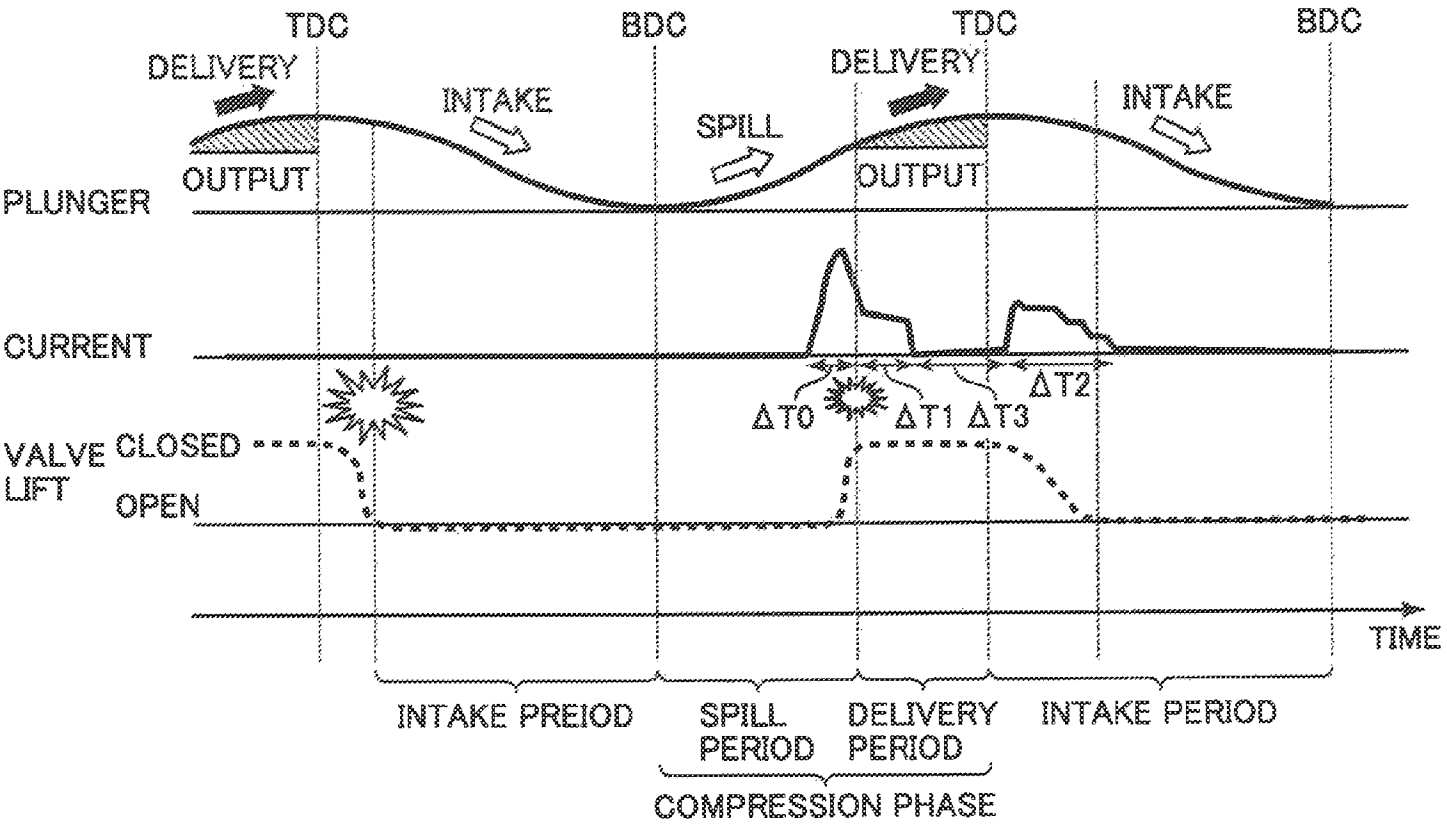
FIG. 9 exemplarily illustrates the control of an integrated-type solenoid-actuated intake valve according to a fourth embodiment of the present invention.

FIG. 9 exemplarily illustrates the control of a solenoid-actuated intake valve according to a fourth embodiment of the present invention. The upper row in FIG. 9 illustrates the plunger movement of the movable plunger 130 reciprocating between the bottom dead center position BDC and the top dead center position TDC. The middle row in FIG. 9 illustrates the control current applied to the solenoid coil 125 and the lower row in FIG. 9 illustrates the movement of the intake valve 120, in particular the valve member 121, between the fully open position and the fully closed position.

The basic control principle in FIG. 9 is similar to the control principle described with reference to FIG. 4, however, in accordance with the fourth embodiment of the present invention, after the movable plunger 130 has reached the top dead center position TDC and is moving again towards the bottom dead center position BDC, control current is applied again to the solenoid 125 during a second time period ΔT2. Specifically, during the second time period ΔT2, a deceleration current impulse is applied to the solenoid 125 by first energizing the solenoid 125 quickly by increasing the control current to a maximal deceleration pulse current control value which may be substantially of the same amplitude as the control current applied during the first time period ΔT1 (as shown in the FIG. 9) or not. The control current is for a short time period kept substantially at the maximal deceleration pulse current control value before it is gradually reduced down to zero. As a consequence, the opening movement of the intake valve can be decelerated and due to the gradually decreasing control current value, the intake valve 120 smoothly reaches the fully open position without generating a significant impact noise.

Figure 10:
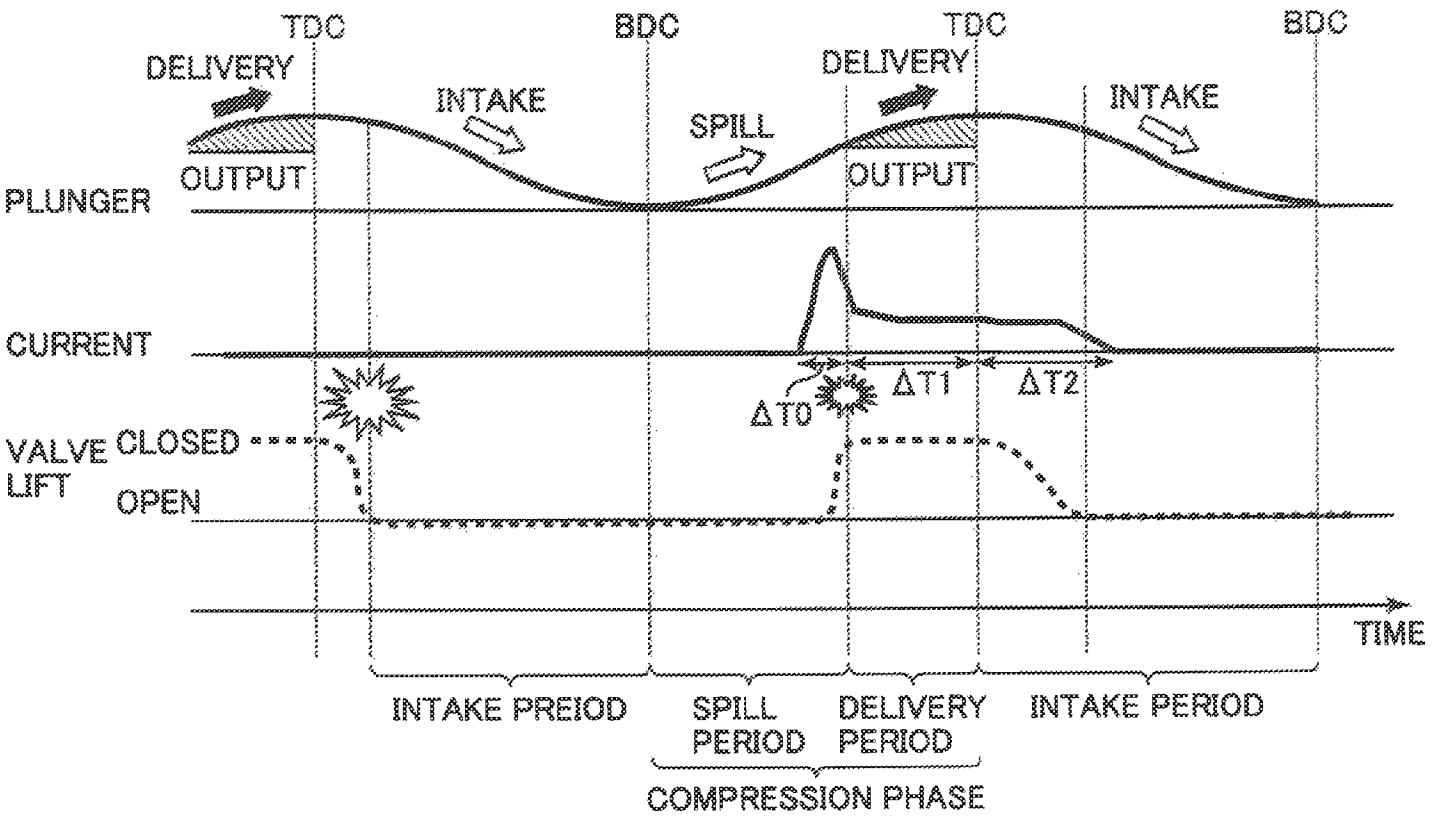
FIG. 10 exemplarily illustrates the control of an integrated-type solenoid-actuated intake valve according to a fifth embodiment of the present invention.

FIG. 10 exemplarily illustrates the control of a solenoid-actuated intake valve according to a fifth embodiment of the present invention. The upper row in FIG. 10 illustrates the plunger movement of the movable plunger 130 reciprocating between the bottom dead center position BDC and the top dead center position TDC. The middle row in FIG. 10 illustrates the control current applied to the solenoid coil 125 and the lower row in FIG. 10 illustrates the movement of the intake valve 120, in particular the valve member 121, between the fully open position and the fully closed position.

The basic control principle in FIG. 10 is similar to the control principle described with reference to FIG. 6, however, in accordance with the fifth embodiment of the present invention, control current is continuously applied at a substantial constant value from the first to the second time periods ΔT1 and ΔT2. During the second time period ΔT2, the control current is for a short time period kept substantially at the maximal deceleration pulse current control value before it is gradually reduced down to zero, in particular linearly reduced down to zero. As a consequence, the opening movement of the intake valve can be decelerated and due to the gradually decreasing control current value, the intake valve 120 smoothly reaches the fully open position without generating a significant impact noise.

Figure 11:
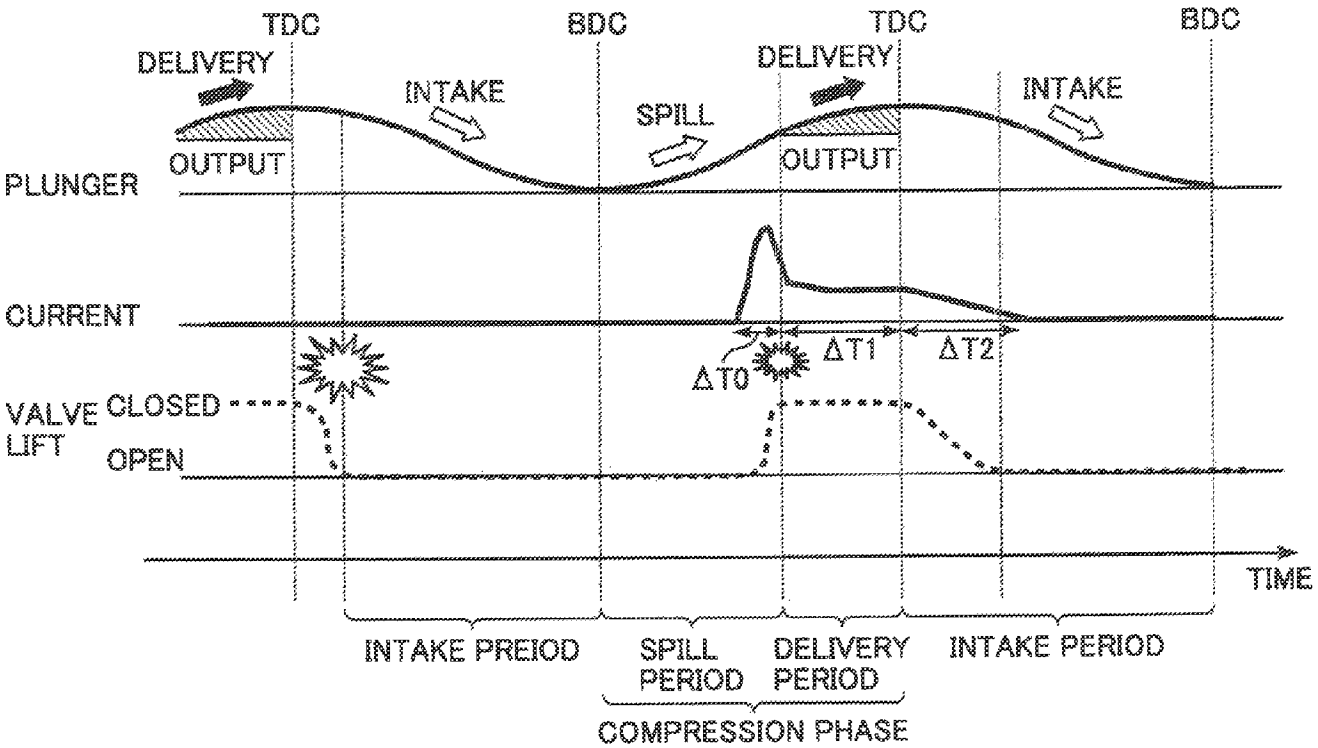
FIG. 11 exemplarily illustrates the control of an integrated type solenoid-actuated intake valve according to a sixth embodiment of the present invention.

FIG. 11 exemplarily illustrates the control of a solenoid-actuated intake valve according to a sixth embodiment of the present invention. The upper row in FIG. 11 illustrates the plunger movement of the movable plunger 130 reciprocating between the bottom dead center position BDC and the top dead center position TDC. The middle row in FIG. 11 illustrates the control current applied to the solenoid coil 125 and the lower row in FIG. 11 illustrates the movement of the intake valve 120, in particular the valve member 121, between the fully open position and the fully closed position.

The basic control principle in FIG. 11 is similar to the control principle described with reference to FIG. 7, however, in accordance with the sixth embodiment of the present invention, control current is continuously applied at a substantial constant value from the first to the second time periods ΔT1 and ΔT2. During the second, time period ΔT2, substantially from the time at which the movable plunger 130 reaches the top dead center, the control current is gradually reduced down to zero (the control current may also be gradually reduced from a time even before or after the movable plunger 130 reaches the top dead center), in particular substantially linearly decreased clown to zero. As a consequence, the opening movement of the intake valve can be decelerated and due to the gradually decreasing control current value, the intake valve 120 smoothly reaches the fully open position without generating a significant impact noise.

Figure 12:
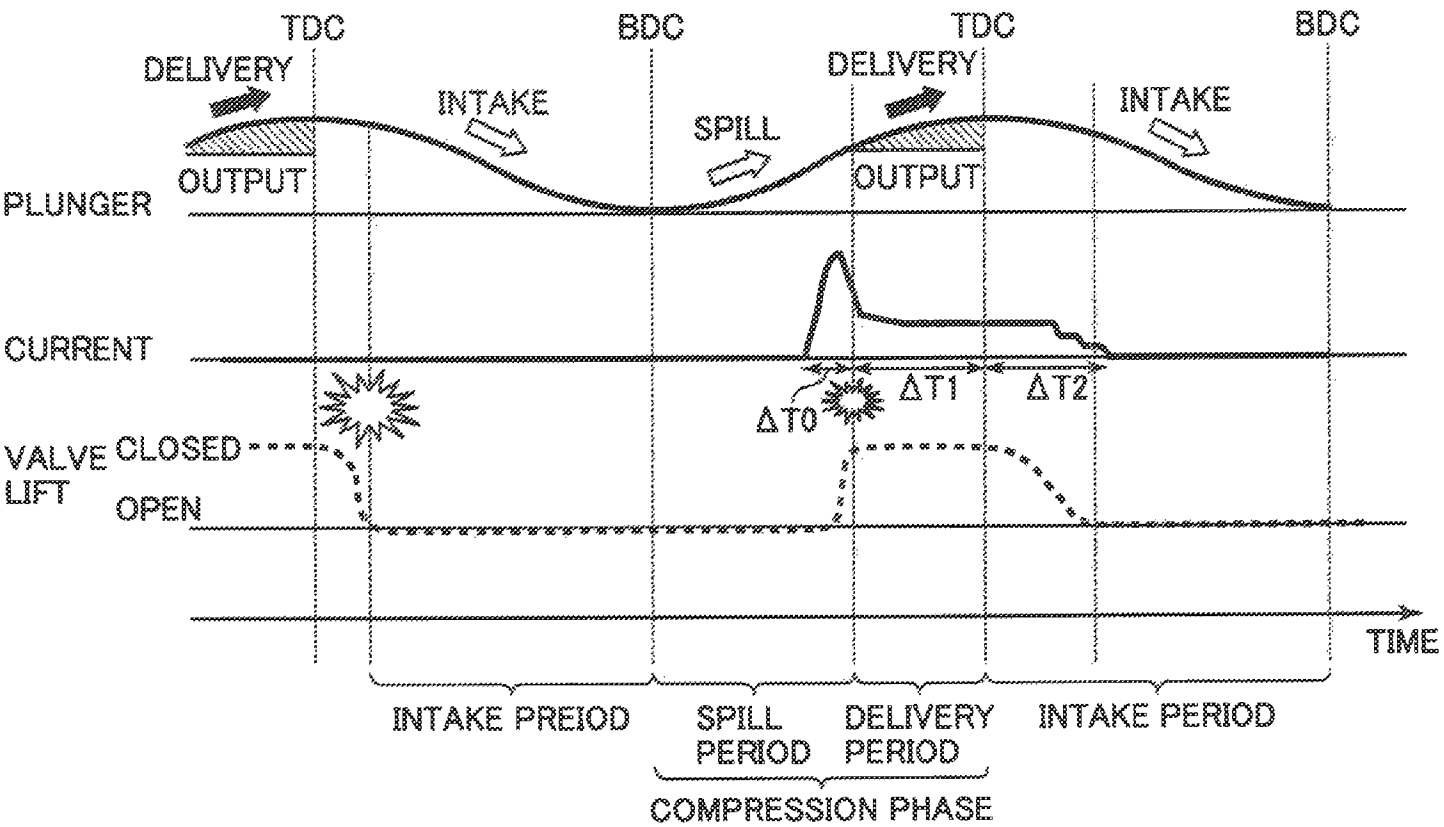
FIG. 12 exemplarily illustrates the control of an integrated-type solenoid-actuated intake valve according to a seventh embodiment of the present invention.

FIG. 12 exemplarily illustrates the control of a solenoid-actuated intake valve according to a seventh embodiment of the present invention. The upper row in FIG. 12 illustrates the plunger movement of the movable plunger 130 reciprocating between the bottom dead center position BDC and the top dead center position TDC. The middle row in FIG. 12 illustrates the control current applied to the solenoid coil 125 and the lower row in FIG. 12 illustrates the movement of the intake valve 120, in particular the valve member 121, between the fully open position and the fully closed position.

Figure 13:
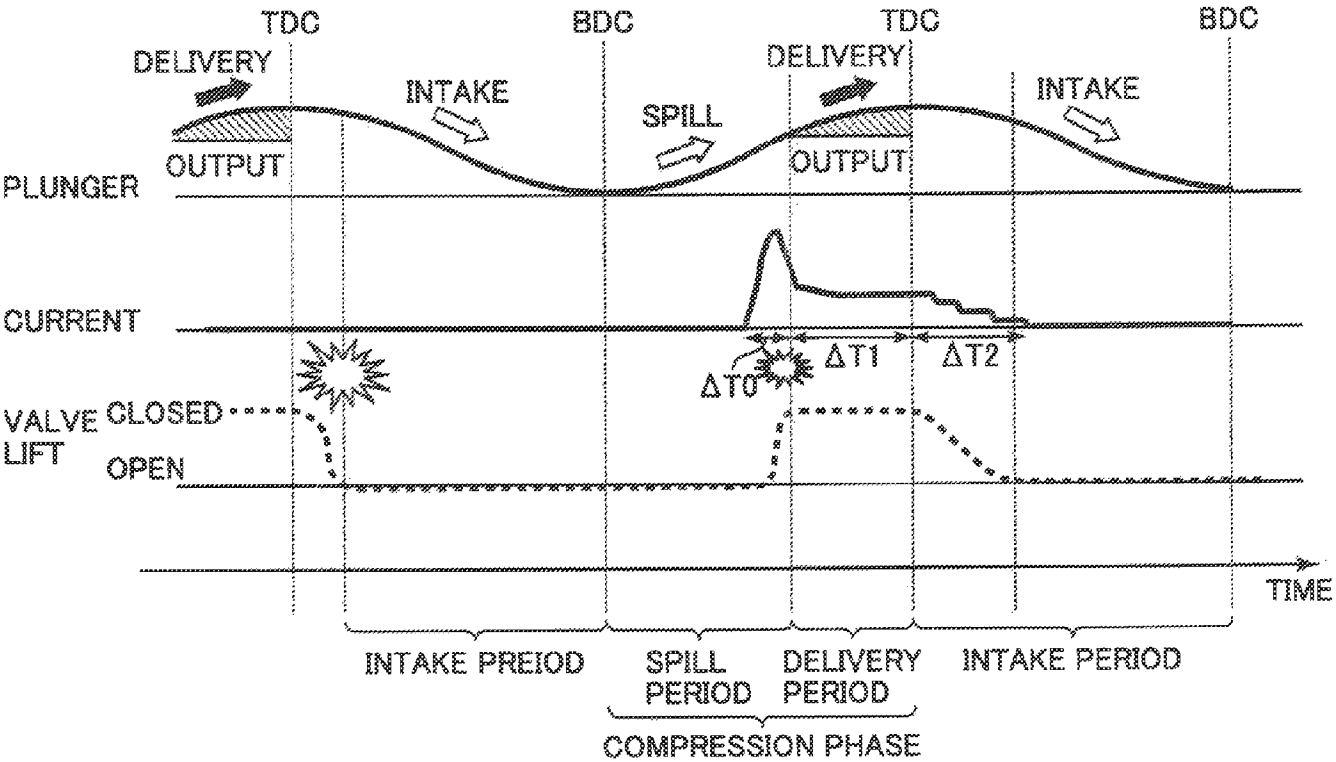
FIG. 13 exemplarily illustrates the control of an integrated-type solenoid-actuated intake valve according to an eighth embodiment of the present invention.

The basic control principle in FIG. 12 is similar to the control principle described with reference to FIG. 9, however, in accordance with the seventh embodiment of the present invention, control current is continuously applied at a substantial constant value from the first to the second time periods ΔT1 and ΔT2. During the second time period ΔT2, the control current is for a short time period kept substantially at the maximal deceleration pulse current control value before it is gradually reduced down to zero. As a consequence, the opening movement of the intake valve can be decelerated and due to the gradually decreasing control current value, the intake valve 120 smoothly reaches the fully open position without generating a significant impact noise. FIG. 13 exemplarily illustrates the control of a solenoid-actuated intake valve according to an eighth embodiment of the present invention. The upper row in FIG. 13 illustrates the plunger movement of the movable plunger 130 reciprocating between the bottom dead center position BDC and the top dead center position TDC. The middle row in FIG. 13 illustrates the control current applied to the solenoid coil 125 and the lower row in FIG. 13 illustrates the movement of the intake valve 120, in particular the valve member 121, between the fully open position and the fully closed position.

The basic control principle in FIG. 13 is similar to the control principle described with reference to FIG. 8, however, in accordance with the eighth embodiment of the present invention, control current is continuously applied at a substantial constant value from the first to the second time periods ΔT1 and ΔT2 During the second time period ΔT2, substantially from the time at which the movable plunger 130 reaches the top dead center, the control current is gradually reduced down to zero (the control current may also be gradually reduced from a time even before or after the movable plunger 130 reaches the top dead center). As a consequence, the opening movement of the intake valve can be decelerated and due to the gradually decreasing control current value, the intake valve 120 smoothly reaches the fully open position without generating a significant impact noise.

Figure 14:
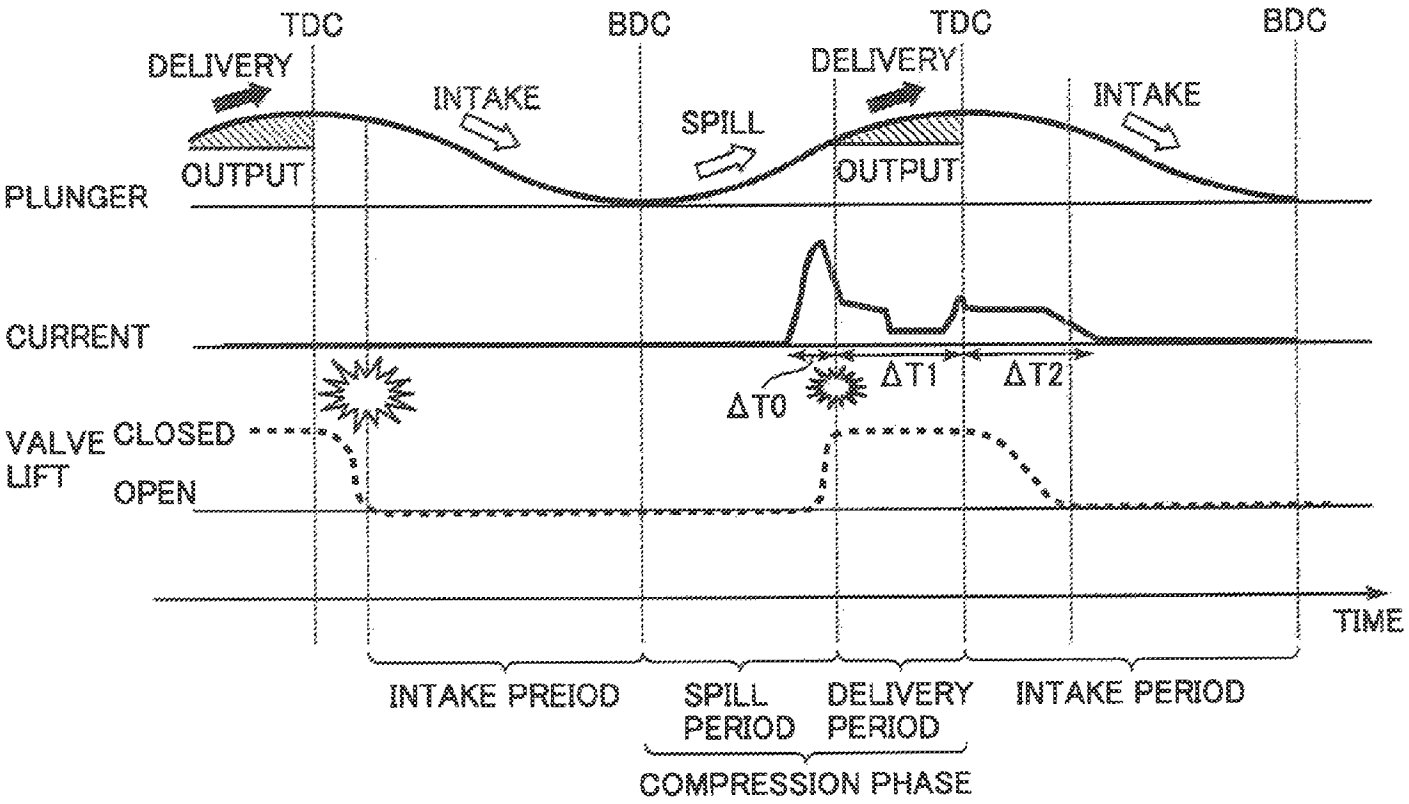
FIG. 14 exemplarily illustrates the control of an integrated-type solenoid-actuated intake valve according to a ninth embodiment of the present invention.

FIG. 14 exemplarily illustrates the control of a solenoid-actuated intake valve according to a ninth embodiment of the present invention. The upper row in FIG. 14 illustrates the plunger movement of the movable plunger 130 reciprocating between the bottom dead center position BDC and the top dead center position TDC. The middle row in FIG. 14 illustrates the control current applied to the solenoid coil 125 and the lower row in FIG. 14 illustrates the movement of the intake valve 120, in particular the valve member 121, between the fully open position and the fully closed position.

Figure 15:
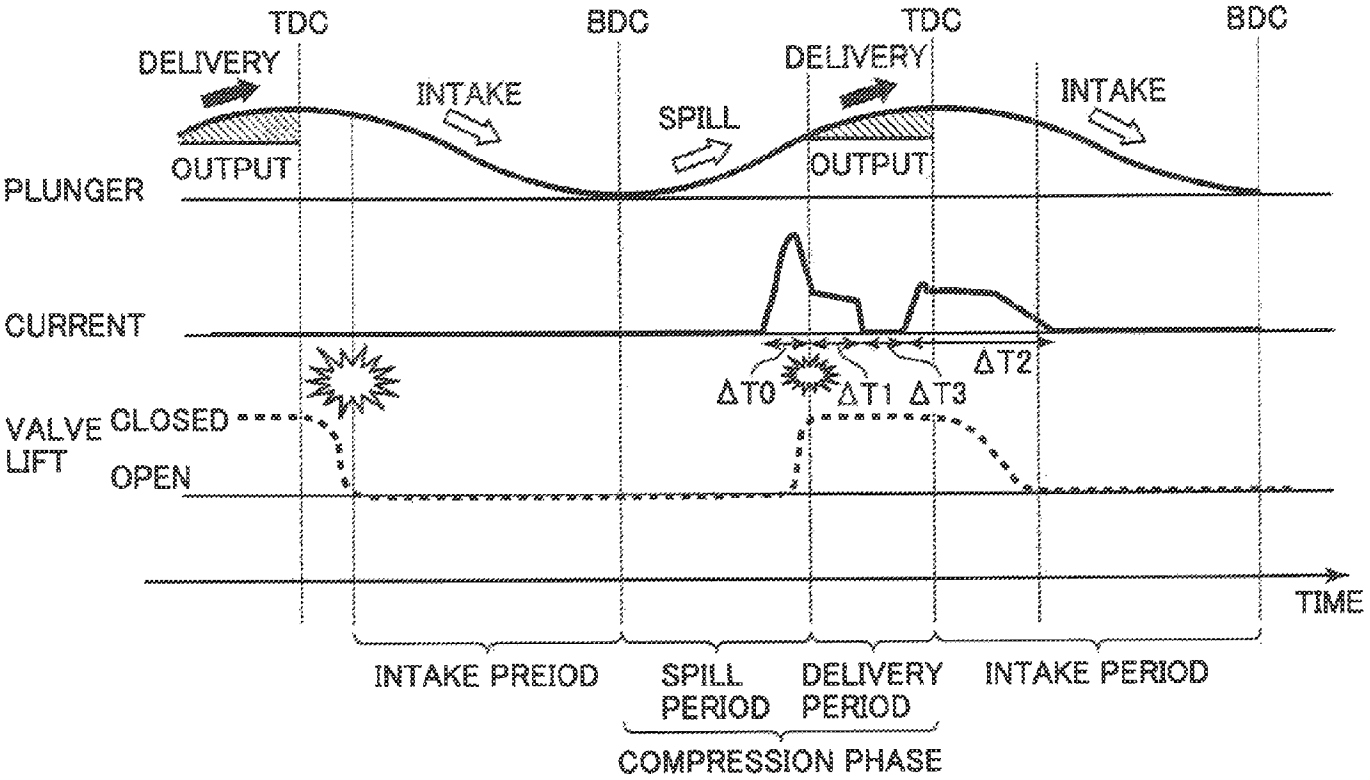
FIG. 15 exemplarily illustrates the control of an integrated-type solenoid-actuated intake valve according to a tenth embodiment of the present invention.

The basic control principle in FIG. 14 is similar to the control principle described with reference to FIG. 10, however, in accordance with the ninth embodiment of the present invention, although control current is continuously applied from the first to the second time periods ΔT1 and ΔT2, the control current is reduced to a smaller current value during the first time period ΔT1 at the end of the delivery period for reasons of reducing energy consumption and avoiding thermal overload. During the second time period ΔT2, the control current is increased again and then the control current is for a short time period kept substantially at the maximal deceleration pulse current control value before it is gradually reduced down to zero, in particular linearly reduced down to zero. As a consequence, the opening movement of the intake valve can be decelerated and due to the gradually decreasing control current value, the intake valve 120 smoothly reaches the fully open position without generating a significant impact noise. FIG. 15 exemplarily illustrates the control of a solenoid-actuated intake valve according to a tenth embodiment of the present invention. The upper row in FIG. 15 illustrates the plunger movement of the movable plunger 130 reciprocating between the bottom dead center position BDC and the top dead center position TDC. The middle row in FIG. 15 illustrates the control current applied to the solenoid coil 125 and the lower row in FIG. 15 illustrates the movement of the intake valve 120, in particular the valve member 121, between the fully open position and the fully closed position.

The basic control principle in FIG. 15 is similar to the control principle described with reference to FIG. 6. During a third time period ΔT3 between the first and second time periods ΔT1 and ΔT2, no control current is applied. Specifically, during the second time period ΔT2, a deceleration, current impulse is applied to the solenoid 125 by first energizing the solenoid 125 quickly by increasing the control current to a maximal deceleration pulse current control value which may be substantially of the same amplitude as the control current applied during the first time period ΔT1 (as shown in the FIG. 15) or not. In contrast to FIG. 6, the deceleration pulse during the second time period ΔT2 is already applied and control current is already increased again before the movable plunger 130 reaches the top-dead center position TDC. The control current is for a short time period kept substantially at the maximal deceleration pulse current control value before it is gradually reduced down to zero, in particular continuously and substantially linearly decreased down to zero. As a consequence, the opening movement of the intake valve can be decelerated and due to the gradually decreasing control current value, the intake valve 120 smoothly reaches the fully open position without generating a significant impact noise.

Figure 16B:
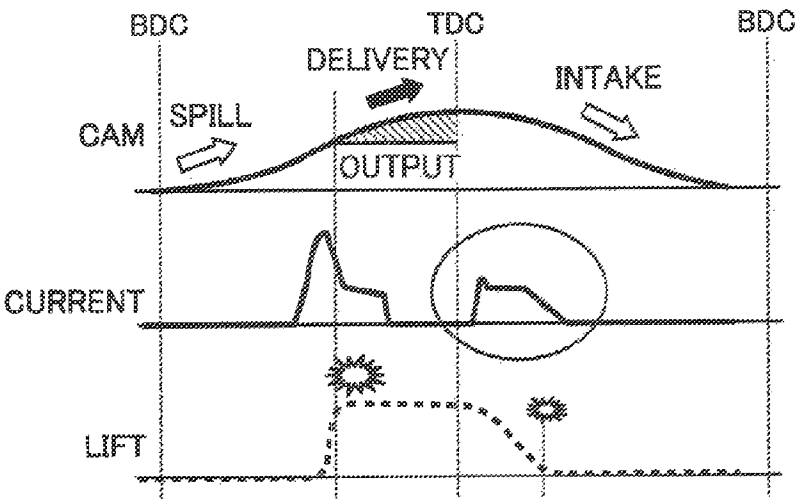
FIGS. 16A and 16B exemplarily illustrate a comparison of the control of a solenoid-actuated intake valve according to the first-type operation without reducing the control current during the second time period and the control of a solenoid-actuated intake valve according to the first-type operation with reducing the control current during the second time period and the control of a solenoid-actuated intake valve according to an embodiment of the invention.
Figure 16A:
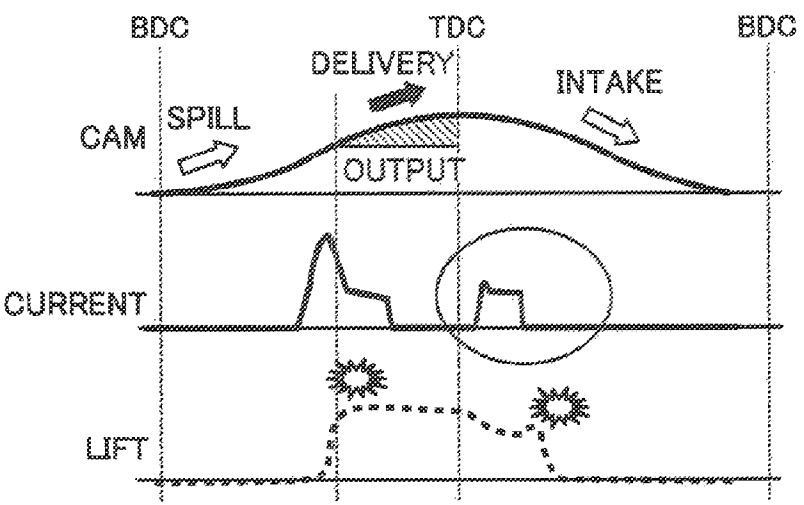

The effect of the present invention compared to a deceleration impulse that is not gradually reduced according to the present invention is illustrated in FIGS. 16A and 163, which exemplarily illustrate a comparison of the control of a solenoid-actuated intake valve according to the first-type operation without gradually reducing the control current during the second time period (cf. FIG. 16A) and the control of a solenoid-actuated intake valve according to the first-type operation with reducing the control current during the second time period and the control of a solenoid-actuated intake valve according to an embodiment of the invention (FIG. 16B; similar to FIG. 6). While the embodiment of the present invention shown in FIG. 16B makes it possible that the intake valve 120 smoothly reaches the fully open position without generating a significant impact noise, the opening movement of the intake valve 120 of FIG. 16A is not only stopped but the intake valve 120 is actually moved again in the direction of closing the intake valve, if the magnetic force becomes larger than the biasing force unless the deceleration pulse is not very accurately and precisely adjusted to the operating conditions such as the engine speed and the temperature of the fuel as well as to individual properties of the intake valve which can vary from one high-pressure fuel, pump to another high-pressure fuel supply pump due to mass production deviations. Then, when the control current is shut off, the intake valve opens rapidly and generates a loud impact noise although the deceleration impulse is intended, to reduce the impact noise.

Figure 17A:
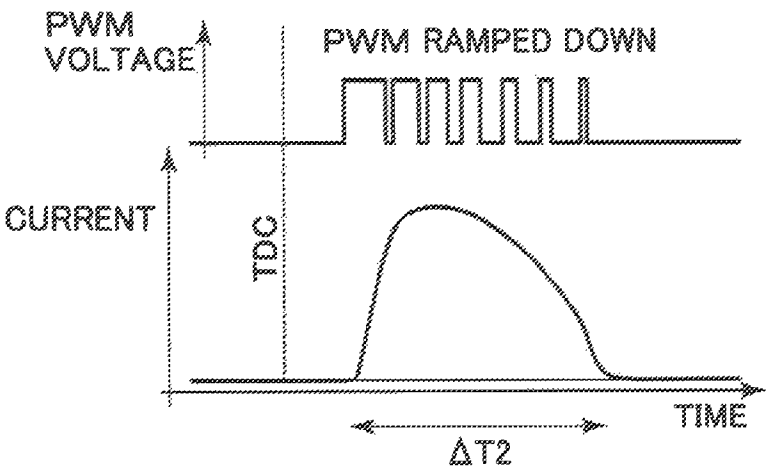
FIG. 17A exemplarily illustrates a ramped-down PWM control according to an embodiment of the present invention and FIG. 17B exemplarily illustrates a stepped-down PWM control according to an embodiment of the present invention.

FIG. 17A exemplarily illustrates a ramped-down PWM control according to an embodiment of the present invention. The upper row of FIG. 17A shows an example of a ramped down PWM voltage signal that can be applied to the solenoid of the solenoid-actuated intake valve for controlling the control current during the second time period $\Delta T2$ for continuously decreasing the control current. The applied ramped down PWM voltage signal starts at a certain predetermined maximal duty cycle (e.g. 85%, 90%, 95% or higher) and is then over time continuously decreased to a predetermined minimal duty cycle smaller than the predetermined maximal duty cycle (which may be even zero). The lower row of FIG. 17A exemplarily illustrates the resulting control current which first increases due to the PWM voltage signal and is then continuously decreased due to the continuously decreasing duty cycle of the PWM voltage signal.

Figure 17B:
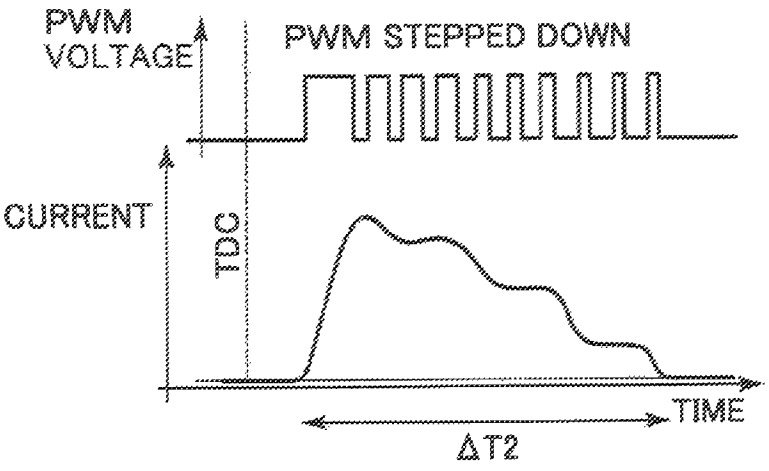

FIG. 17B exemplarily illustrates a stepped-down PWM control according to an embodiment of the present invention. The upper row of FIG. 17B shows an example of a stepped down PWM voltage signal that can be applied to the solenoid of the solenoid-actuated intake valve for controlling the control current during the second time period $\Delta T2$ for gradually decreasing the control current. The applied stepped down PWM voltage signal starts at a certain predetermined maximal duty cycle (e.g. 85%, 90%, 95% or higher) and is then over time gradually decreased from the maximal duty cycle to one or more intermediate duty cycles to a predetermined minimal duty cycle smaller than the predetermined maximal duty cycle (which may be even zero). The lower row of FIG. 17B exemplarily illustrates the resulting control current which first increases due to the PWM voltage signal and is then gradually decreased due to the stepwise decreasing duty cycle of the PWM voltage signal. Summarizing, the present invention allows to provide a method and a control apparatus for efficiently controlling a high-pressure fuel supply pump comprising a normally-open solenoid actuated intake valve with reduced noise, in particular while being less dependent on an accurate adjustment and precise calculation of the timing and the amplitude of a deceleration pulse.

What is claimed is:

1. A method for controlling a high-pressure fuel supply pump configured to supply pressurized fuel to an internal combustion engine, the high-pressure fuel supply pump comprising a compression chamber, a solenoid-actuated intake valve configured to deliver unpressurized fuel to the compression chamber, a movable plunger reciprocating in the compression chamber between a first plunger position (BDC) and a second plunger position (TDC), the movable plunger pressurizing fuel in the compression chamber, and a discharge valve configured to discharge pressurized fuel from the compression chamber to be supplied to the internal combustion engine, the solenoid-actuated intake valve being configured to be biased into a first direction towards a first stop position by means of a biasing force and being configured to be displaced against the biasing force into a second direction opposite to the first direction towards a second stop position by means of a magnetic force and to be kept at the second stop position by means of the magnetic force, the method comprising:

applying a first control current to the solenoid-actuated intake valve, the first control current displacing the solenoid-actuated intake valve into the second direction to the second stop position during a first compression period in which the movable plunger moves upward;

subsequently shutting off the first control current but keeping the solenoid-actuated intake valve at the second stop position during the first compression period;

subsequently applying a second control current to the solenoid-actuated intake valve during an intake period in which the movable plunger moves downward, the intake period immediately following the first compression period; and, subsequently decreasing the second control current being applied during the intake period down to zero, wherein a peak of the first control current is larger than a peak of the second control current.

2. The method according to claim 1, wherein the solenoid-actuated intake valve is a normally-open-type solenoid-actuated intake valve being configured to be closed and/or kept closed by means of magnetic force, wherein the first stop position is a fully open position of the solenoid-actuated intake valve, the first direction is an opening direction of the solenoid-actuated intake valve, the second stop position is a fully closed position of the solenoid-actuated intake valve and the second direction is a closing direction of the solenoid-actuated intake valve; or the solenoid-actuated intake valve is a normally-closed-type solenoid-actuated intake valve being configured to be opened and/or kept open by means of magnetic force, wherein the first stop position is a fully closed position of the solenoid-actuated intake valve, the first direction is a closing direction of the solenoid-actuated intake valve, the second stop position is a fully open position of the solenoid-actuated intake valve and the second direction is an opening direction of the solenoid-actuated intake valve.

3. The method according to claim 1, wherein the first control current to the solenoid-actuated intake valve is controlled by applying a pulse-width modulation voltage signal to the solenoid-actuated intake valve; and gradually decreasing the second control current value by decreasing a duty cycle of the applied pulse-width modulation voltage signal; or gradually decreasing the second control current value by continuously decreasing a duty cycle of the applied pulse-width modulation voltage signal.

4. The method according to claim 1, wherein the solenoid-actuated intake valve is a normally-open-type solenoid-actuated intake valve being configured to be closed or kept closed by means of magnetic force; and the operation of the high-pressure fuel supply pump comprises:

the intake period in which fuel is taken in through the solenoid-actuated intake valve into the compression chamber while the movable plunger moves from the second plunger position (TDC) to the first plunger position (BDC) and the solenoid-actuated intake valve opens or is kept open by means of a biasing force or by means of a biasing force and a hydraulic force, a spill period in which fuel is spilled out of the compression chamber through the solenoid-actuated intake valve while the movable plunger moves from the first plunger position (BDC) to the second plunger position (TDC) and the solenoid-actuated intake valve is kept open by means of a biasing force, and a delivery period in which fuel is pressurized in the compression chamber and discharged through the discharge valve to be supplied to the internal combustion engine while the movable plunger moves from the first plunger position (BDC) to the second plunger position (TDC) and the solenoid-actuated intake valve is kept closed by means of magnetic force.

5. The method according to claim 1, wherein the solenoid-actuated intake valve is a normally-open-type solenoid-actuated intake valve being configured to be closed or kept closed by means of magnetic force; and the operation of the high-pressure fuel supply pump comprises:

the intake period in which fuel is taken in through the solenoid-actuated intake valve, if the solenoid-actuated intake valve is kept open during the intake period, or through an auxiliary valve, if the solenoid-actuated intake valve is kept closed during the intake period by applying the first control current to the solenoid-actuated intake valve, into the compression chamber while the movable plunger moves from the second plunger position (TDC) to the first plunger position (BDC), a delivery period in which fuel is pressurized in the compression chamber and discharged through the discharge valve to be supplied to the internal combustion engine while the movable plunger moves from the first plunger position (BDC) to the second plunger position (TDC) and the solenoid-actuated intake valve is kept closed by means of the magnetic force, and a spill period in which fuel is spilled out of the compression chamber through the solenoid-actuated intake valve while the movable plunger moves from the first plunger position (BDC) to the second plunger position (TDC) and the solenoid- actuated intake valve opens or is kept open by means of a biasing force or by means of a biasing force and a hydraulic force, wherein a time period of applying or decreasing the second control current is included in the spill period.

6. The method according to claim 1, wherein the second control current is applied to the solenoid-actuated intake valve during the intake period such that an acceleration of the movement of the solenoid-actuated intake valve into the first direction is prevented, prior to a time at which the solenoid-actuated intake valve reaches the first stop position, such that a movement of the solenoid-actuated intake valve into the first direction is decelerated, prior to a time at which the solenoid-actuated intake valve reaches the first stop position.

7. The method according to claim 1, wherein the second control current is applied in the intake period at least until the solenoid-actuated intake valve reaches the first stop position.

8. The method according to claim 1, wherein when the solenoid-actuated intake valve is a normally-open-type solenoid-actuated intake valve being configured to be closed or kept closed by means of magnetic force, the second control current is applied before the movable plunger has reached the second plunger position (TDC);

the second control current is applied after the movable plunger has reached the second plunger position (TDC);

or the second control current is applied substantially at a time at which the movable plunger reaches the second plunger position (TDC).

9. The method according to claim 1, wherein when the solenoid-actuated intake valve is a normally-open-type solenoid-actuated intake valve being configured to be closed or kept closed by means of the magnetic force, a period in which no control current is applied to the solenoid-actuated intake valve includes a time at which the movable plunger reaches the second plunger position (TDC).

10. The method according to claim 1, wherein a control current is continuously applied from applying the first control current to applying the second control current.

11. The method according to claim 10, wherein the control current applied between the first control current and the second control current is smaller than the first control current.

12. The method according to claim 1, wherein the control current applied to the solenoid-actuated intake valve is controlled by means of pulse-width modulation control of an applied voltage signal or by means of closed-loop current control.

13. A control apparatus for controlling a high-pressure fuel supply pump configured to supply pressurized fuel to an internal combustion engine, wherein said control apparatus is configured to control the control current applied to the solenoid actuated intake valve according to the method of claim 1.

14. A non-transitory computer readable medium storing instructions, which when executed control an engine control unit, such that the engine control unit controls a control current applied to the solenoid actuated intake valve according to the method of claim 1.

15. The method according to claim 1, wherein the second control current is reduced during the intake period by repeatedly turning a control signal ON and OFF.

* * * * *